US007133059B2

(12) United States Patent
Mochizuki et al.

(10) Patent No.: US 7,133,059 B2
(45) Date of Patent: Nov. 7, 2006

(54) IMAGE FORMING METHOD

(75) Inventors: Hiroshi Mochizuki, Yamanashi-ken (JP); Wataru Tsuruta, Yamanashi (JP); Masao Watanabe, Yamanashi-ken (JP)

(73) Assignee: Nisca Corporation, Yamanashi-Ken (JP)

( * ) Notice: Subject to any disclaimer, the term of this patent is extended or adjusted under 35 U.S.C. 154(b) by 871 days.

(21) Appl. No.: 10/212,678

(22) Filed: Aug. 6, 2002

(65) Prior Publication Data

US 2003/0030833 A1 Feb. 13, 2003

(30) Foreign Application Priority Data

Aug. 6, 2001 (JP) ..... 2001-237233
Aug. 31, 2001 (JP) ..... 2001-263390
Aug. 31, 2001 (JP) ..... 2001-263502

(51) Int. Cl.
*B41J 3/00* (2006.01)

(52) U.S. Cl. ..... 347/213

(58) Field of Classification Search ..... 347/213
See application file for complete search history.

(56) References Cited

U.S. PATENT DOCUMENTS 5,959,278 A 9/1999 Kobayashi et al.
6,679,637 B1 * 1/2004 Tsuruta et al. ..... 400/120.01
6,796,732 B1 * 9/2004 Kobayashi et al. .... 400/120.01

FOREIGN PATENT DOCUMENTS

JP 8-58124 3/1996
JP 8-58125 3/1996
JP 08-112920 5/1996
JP 9-131930 5/1997
JP 10-029331 2/1998
JP 10-114152 5/1998
JP 10-217516 8/1998
JP 11-263032 9/1999

* cited by examiner

*Primary Examiner*—Huan Tran
(74) *Attorney, Agent, or Firm*—Manabu Kanesaka

(57) ABSTRACT

Transports cards to an image forming portion, and turns cards over after forming images on one side of cards at the image forming portion. Transports an intermediate transfer sheet to an image forming portion, forms images on the intermediate transfer sheet at the image forming portion and transports cards to the transfer portion along with transporting the intermediate transfer sheet to the transfer portion, and transfers images formed on the intermediate transfer sheet at the image forming portion to the other side of cards at the transfer portion. Switching between a direct transfer method and an indirect transfer method makes either transfer method applicable thereby improving printer user convenience, enables the forming of images to a recording medium using the optimum image forming method and reduces running costs. After direct transfer, indirect transfer is consecutively executed without discharging the card from the image forming apparatus thereby protecting the security of personal information and ensuring the security of personal information even when discharging cards printed on one side is unavoidable from the image forming apparatus when printing to both sides is incomplete.

16 Claims, 14 Drawing Sheets

IMAGE FORMING METHOD

BACKGROUND OF THE INVENTION

1. Field of the Invention

This invention relates to an image forming method for printing a variety of information such as images and characters to a recording medium, such as a card, and more particularly to a printing method that is capable of switching printing methods according to the characteristics of the recording medium or the information to print the information.

2. Description of the Related Art

Conventionally, thermal transfer method printing apparatuses that record desired images and characters by thermally transferring with a thermal head via a thermal transfer film to a recording medium are used to create card shaped recording medium, like credit cards, cash cards, license cards and ID cards. As an example, Japanese Patent Publication (Tokkai) No. 09-131930 (U.S. Pat. No. 5,959,278) teaches a direct transfer method printing apparatus that directly transfers images and characters to a recording medium via thermal transfer film. The use of a thermal sublimate ink has the benefit of attaining high quality images because this type of ink is more expressive. However, a receptive layer to receive ink on the surface of a recording medium to which images, etc., are transferred is an essential element to enable this method of printing, so a problem exists in that either the type of recording medium that can be used is limited, or it is necessary to form the aforementioned receptive layer upon the surface of a recording medium.

Generally, cards made of polyvinyl chloride (also known as PVC cards) are widely used as the recording medium because they can receive thermal sublimate ink. However, due to the fact that harmful substances are generated when these cards are burned, there has been consideration given to switching to cards made of polyethylene terephthalate (also known as PET cards). However, PET cards have a crystal-like quality so not only is it difficult to use them for thermal sublimate printing, but embossing them is also difficult. Thus, if it is necessary to emboss the surface of the recording medium, the use of PVC cards is presently unavoidable.

Furthermore, in recent years there are card shaped media of the type having IC chips or antennae embedded therein such as IC cards, which are being used in a variety of fields. Because the embedding of such elements into the card, the surface of the card becomes uneven resulting in problems in transferring images.

Japanese Patent Publication (Tokkai) No. 08-58124 teaches the technology of an indirect transfer method printing apparatus that transfers an image to an intermediate transfer medium once, then transfers that image again to the recording medium, as a method for overcoming the aforementioned problems. According to this method, it is possible to overcome the problems such as the limitation of recording medium related to the receptive layer or the transferring of images to an uneven surface of the recording medium which had been considered demerits of the direct transfer method. Furthermore, this method has the advantage of being easier to printing to the entire surface of the card shaped recording medium compared to the direct transfer method.

In Japanese Patent Publication (Tokkai) No. 11-263032 is disclosed a configuration that establishes a pooling mechanism that functions as a buffer for the transfer sheet between an image forming means that forms images to a belt-shaped transfer sheet (intermediate transfer film) and a re-transferring means that re-transfers images transferred to the transfer sheet to a card that is the target for receiving the image thereby enabling the lining up of the image forming process and the re-transferring process. Disclosed in Japanese Patent Publication (Tokkai) No. 08-58125 is a thermal transfer printing apparatus that prints to both the front and back surfaces of a recording paper, configured to transfer ink to an intermediate transfer film using a thermal head and after forming an image, to re-transfer the ink image to a recording paper surface by a heat roller, and configured to transfer ink to the back side of a recording paper with a thermal head that is different from the aforementioned thermal head, the thermal head for transferring ink to the back surface of the recording paper surface interposed by an ink film is opposingly arranged to a heat roller for the retransfer process.

However, running costs for the intermediate transfer method are higher than the direct transfer method because an intermediate transfer medium must be used. Printing also takes longer. Furthermore, depending on the design of the card, even if the entire front surface is required for printing, often times only the back side is used to print precautions for card use, thus there are fewer cases requiring printing over the entire surface. Thus, it can be said that there are merits and demerits for both methods of printing. Still further, Japanese Patent Publication (Tokkai) No. 11-263032 arranges the image forming process and the re-transferring process lined up adjacently, but it only handles the aforementioned indirect transfer method. Furthermore, to print to both front and back surfaces of a recording medium on the same thermal transfer printing apparatus according to the apparatus disclosed in Japanese Patent Publication (Tokkai) No. 08-58125, it is necessary for the transport speed to be different for the recording medium when being processed by the heat roller or the thermal head. When both surfaces of the recording medium are heated, it has been pointed out that the problem of poor peeling of the film occurs as a result of the high temperature of the intermediate transfer film.

Therefore, to handle information relating to printing, such as the surface shape and characteristics of the recording medium including the type of material of the recording medium such as whether it is PVC or PET, embossed or whether or not it includes IC elements and whether or not it is necessary to print to the entire surface of the recording medium, and the various purposes, if there is an image printing method that can switch printing methods between the direct transfer method and the indirect transfer method to print to a recording medium with either transfer method, convenience to users who are printing would be improved and running costs associated with printing using the optimum image forming method to the recording medium would be reduced.

Also, when forming images to both sides of a recording medium using such an image forming method, generally, private personal information relating to the owner of the recording medium is recorded onto one surface of the recording medium, so from the point of view of security to protect personal information, it is not preferable to form images such as precautions on the other side of the recording medium using the image forming apparatus again after the recording medium having been recorded with personal information on one side has been discharged from the image forming apparatus wherein the aforementioned image forming method was executed, and in the event it is necessary to discharge the recording medium with images formed only on one side from the image forming apparatus for some reason such as an error in a machine failure or power outage, it is preferable to discharge the recording medium with only precautions that does not include personal information printed on one side. To rephrase this, when printing to both sides of a recording medium, providing for the unavoidable discharge of recording medium before printing is completed, without discharging the recording medium from the image forming apparatus until the printing of both sides of the recording medium has been completed, cautions, etc., are formed as images on the recording medium in advance to increase the security to protect personal information by forming images relating to personal information last. Here, security means not only protection of personal information in the image forming apparatus wherein the image forming method is performed normally, but also the protecting of personal information providing for emergency situations in the image forming apparatus.

Furthermore, when switching the image forming method between the direct transfer method and the indirect transfer method to form images to the front and back sides of a recording medium, if after images are formed on one side of a recording medium using the indirect transfer method, images are formed on the other side of a recording medium using the direct transfer method, the fixing of the image transferred in the former image forming on the recording medium will be improved.

When printing (forming images) with a configuration wherein both methods exist inside the printing apparatus, to make the entire printing apparatus more compact and to attain low costs, the sharing of portions of the image forming portion that are used in both methods and when the direct transfer method is selected, the recording medium and the intermediate transfer medium are transported in contact at the image forming position, accompanying the sharing of members. Contact friction of the intermediate transfer medium will be large if the recording medium in contact thereto is moved and the intermediate transfer medium not being used is not transported when using the direct transfer method, resulting in damage to the unused portion of the intermediate transfer medium and thus printing problems in the indirect transfer method.

OBJECT OF THE INVENTION

An object of the present invention is to provide an image forming method that can switch image forming between the direct transfer method and the indirect transfer method and that can print with the optimum image forming method for the recording medium to improve printer user convenience and to reduce running costs associated with printing.

Another object of the present invention is to provide an image forming method that can switch between the direct transfer method and the indirect transfer method for printing and ensure security.

Still another object of the present invention is to provide an image forming method that can switch between the direct transfer method and the indirect transfer method for printing and improve the affixing of images to the recording medium.

Still another object of the present invention is to provide an image forming method that can switch between the direct transfer method and the indirect transfer method for printing and securely execute the image forming process using both methods without the problems of transfer methods on the other side of the recording medium when the direct transfer method is selected for one side.

SUMMARY OF THE INVENTION

In order to attain the aforementioned objectives, the image forming method according to the present invention comprises a first image forming process that transports the recording medium to the first image forming position and forms images on the aforementioned recording medium at the aforementioned first image forming position and a second image forming process that transports an intermediate transfer medium that temporarily holds images to the first image forming position, then transports the aforementioned recording medium along with the aforementioned intermediate transfer medium to the second image forming position after images are formed on the aforementioned intermediate transfer medium at the aforementioned first image forming position and transfers images formed on the aforementioned intermediate transfer medium to the aforementioned recording medium, and that executes the forming of images on the other side of the aforementioned recording medium using the aforementioned second image forming process after forming images on one side of the aforementioned recording medium using the first image forming process.

The aforementioned first image forming process can also form images using single colors to the aforementioned recording medium. Also, the aforementioned second image forming process can be the image forming process that forms color images to the aforementioned recording medium and when doing so, the aforementioned second image forming process can form images of personal information, including pictures.

It is preferable that a turning process to turn the recording medium over is arranged between the first image forming process and the second image forming process.

Note that when executing image forming using the aforementioned first image forming process, the intermediate transfer medium and the recording medium are transported reciprocally while in contact at the aforementioned first image forming process and that when executing image forming using the aforementioned second image forming process, only the aforementioned intermediate transfer medium is reciprocally transported at the aforementioned first image forming process. When reciprocally transporting the aforementioned recording medium and the aforementioned intermediate transfer medium at the aforementioned first image forming position, it is preferred that the aforementioned recording medium and the aforementioned intermediate transfer medium be transported in synchronization.

Also, image forming method according to the present invention comprises a first image forming process that transports the recording medium to the first image forming position and forms images on the aforementioned recording medium at the aforementioned first image forming position and a second image forming process that transports an intermediate transfer medium that temporarily holds images to the first image forming position, then transports the aforementioned recording medium along with the aforementioned intermediate transfer medium to the second image forming position after images are formed on the aforementioned intermediate transfer medium at the aforementioned first image forming position and transfers images formed on the aforementioned intermediate transfer medium to the aforementioned recording medium, and that executes the forming of images on the other side of the aforementioned recording medium using the aforementioned first image forming process after forming images on one side of the aforementioned recording medium using the second image forming process.

The aforementioned second image forming process can form images to a receptive layer that can receive images, layered on the aforementioned intermediate transfer medium, then form images by transferring the aforementioned receptive layer to one side of the aforementioned recording medium. When doing so, the aforementioned second image forming process heats and presses the aforementioned receptive layer formed thereupon with images to transfer to one side of the aforementioned recording medium.

Also, the aforementioned first image forming process can form images to the other side of the aforementioned recording medium by transferring thermal sublimate ink. When forming images using the aforementioned first image forming process, the one side of the aforementioned recording medium formed thereupon with images by the aforementioned second image forming process is pressingly touched to the aforementioned recording medium support member that supports the aforementioned recording medium.

It is preferable that a turning process to turn the recording medium over be arranged between the second image forming process and the first image forming process.

Note that when executing image forming using the aforementioned first image forming process, the intermediate transfer medium and the recording medium are transported reciprocally while in contact at the aforementioned first image forming position and that when executing image forming using the aforementioned second image forming process, only the aforementioned intermediate transfer medium is reciprocally transported at the aforementioned first image forming position. When reciprocally transporting the aforementioned recording medium and the aforementioned intermediate transfer medium at the aforementioned first image forming process, it is preferred that the aforementioned recording medium and the aforementioned intermediate transfer medium be transported in synchronization.

Furthermore, the image forming method according to the present invention comprises a first image forming process that transports the recording medium to the first image forming position and forms images on the aforementioned recording medium at the aforementioned first image forming position and a second image forming process that transports an intermediate transfer medium that temporarily holds images to the first image forming position, then transports the aforementioned recording medium along with the aforementioned intermediate transfer medium to the second image forming position after images are formed on the aforementioned intermediate transfer medium at the aforementioned first image forming position and transfers images formed on the aforementioned intermediate transfer medium to the aforementioned recording medium, and that can be set to form images in any desired order to one side of the aforementioned recording medium using the aforementioned first image forming process or to form images on the other side of the aforementioned recording medium using the second image forming process.

Other objectives and features of the present invention shall be clearly explained in a detailed description of the preferred embodiment below based upon the drawings provided.

DETAILED DESCRIPTION OF THE DRAWINGS

FIG. 3A is a front view showing a model of the thermal transfer sheet, FIG. 3B is a sectional view showing a model of the intermediate transfer sheet.

Figure 13A:
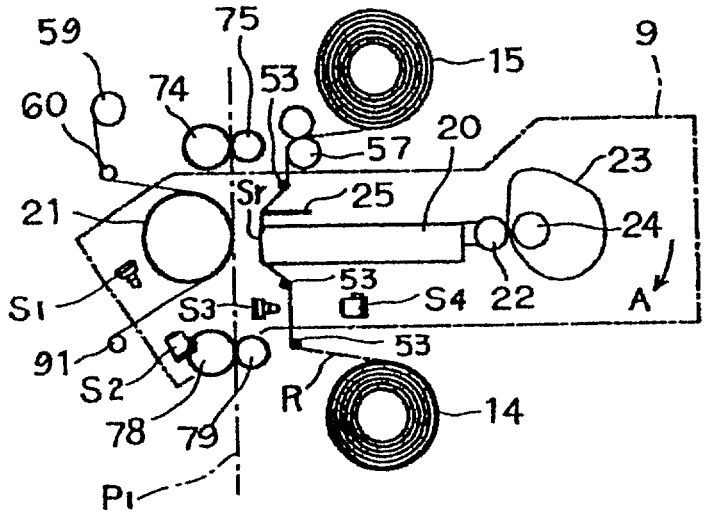
Figure 13B:
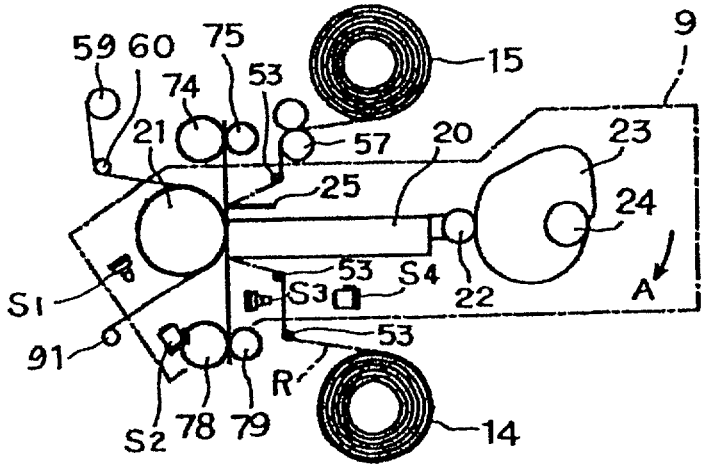
Figure 13C:
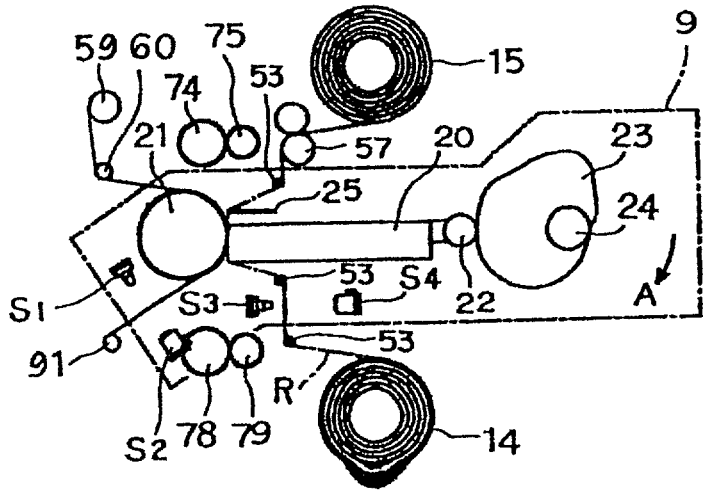

FIG. 13A, FIG. 13B and FIG. 13C are front views of the image forming portion of the image forming apparatus according to the embodiment of the present invention; FIG. 13A shows the thermal head retracted; FIG. 13B shows forming an image on a card by the direct transfer; FIG. 13C shows an image formed on the intermediate transfer sheet.

Figure 14A:
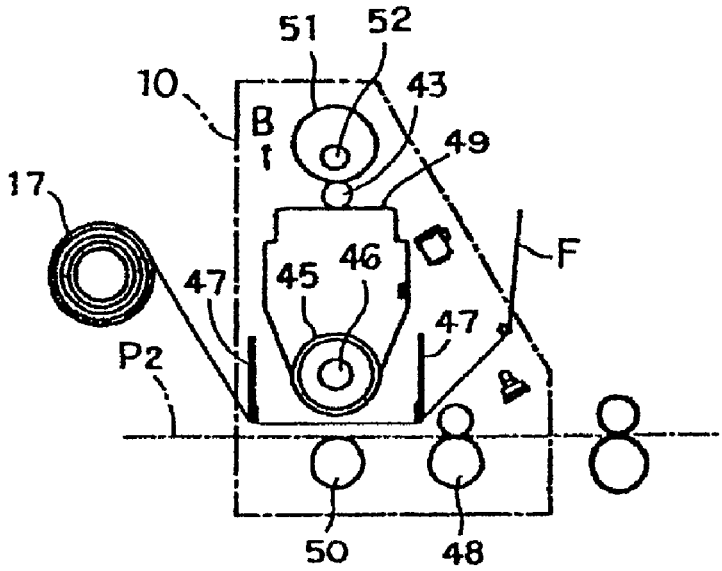
Figure 14B:
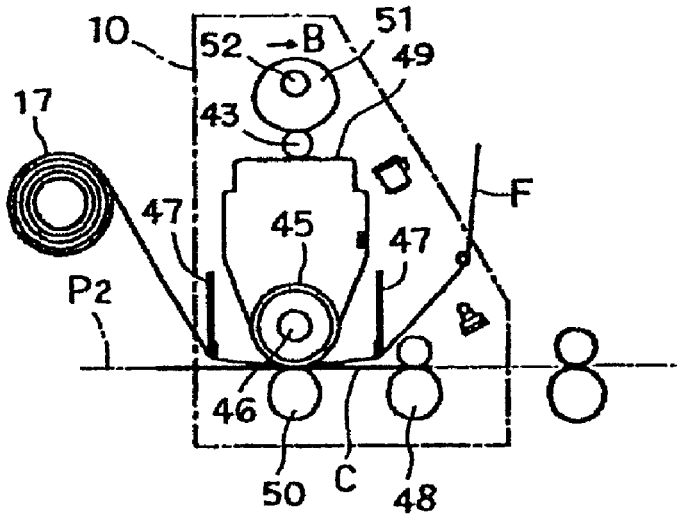

FIG. 14A and FIG. 14B are front views of the transfer portion on the image forming apparatus according to the embodiment of the present invention; FIG. 14A shows the heat roller retracted; FIG. 14B shows transferring an image onto a card using intermediate transfer.

DETAILED DESCRIPTION OF THE PREFERRED EMBODIMENTS

The following shall explain the preferred embodiment of the image forming apparatus capable of applying the image forming method according to the invention, in reference to the drawings provided.

Figure 1:
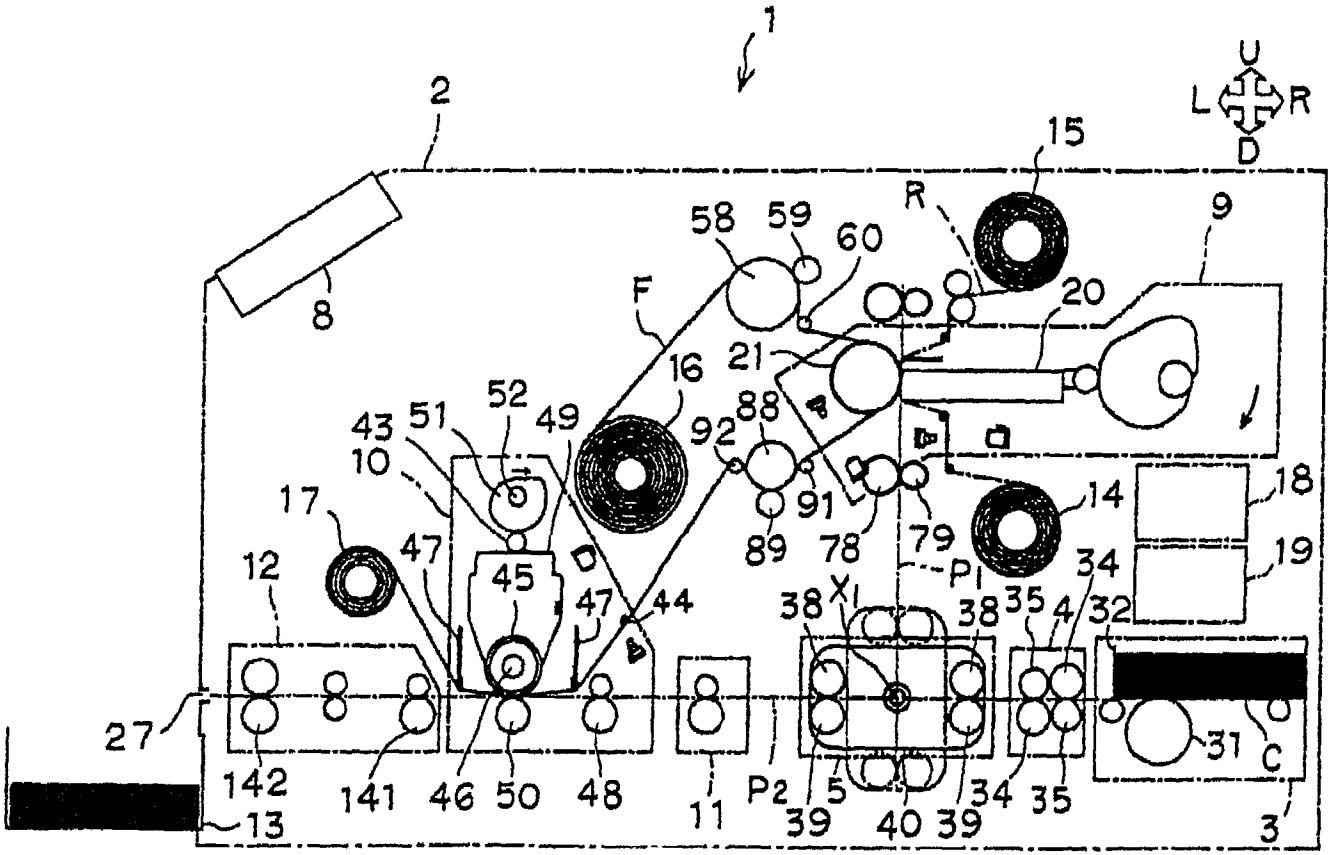
FIG. 1 is a front view showing the general configuration of the image forming apparatus according to an applicable embodiment of the present invention.

As can be clearly seen in FIG. 1, the image forming apparatus 1 according to the embodiment of the present invention comprises in the housing of the frame 2, the first card transport path P1 composed of the card transport path for forming (printing) images to the card C as the recording medium using the direct transfer method, and the second card transport path P2 composed of the card transport path for transferring to the card C images temporarily held on the intermediate transfer sheet F as the intermediate transfer medium, using the indirect transfer method. The second card transport path P2 is disposed substantially horizontally, the first card transport path P1 disposed substantially vertically.

The first card transport path P1 and the second card transport path P2 intersect perpendicularly at intersecting point X1.

On the second card transport path P2 are arranged the card supply portion 3 that separates and feeds the card C one at a time to the second card transport path P2, the cleaner 4 that cleans both surfaces of the card C downstream of the card supply portion 3, and the turning portion 5 that rotates around intersection point X1 downstream of the cleaner 4, nips the card C, and rotates to turn the card C to switch the card C transport path directly toward the first card transport path P1 or the second card transport path P2.

The card supply portion 3 comprises the card stacker to store stacks of a plurality of the card C. The stacker side plate 32 that comprises an opening slot to allow only one of card C to pass therethrough is arranged in the position facing the second card transport path P2 on the card stacker. To the bottom of the card stacker is pressingly arranged the kick roller 31 that rotatingly feeds the bottommost blank card C of a plurality of the blank card C stored in a stack in the card stacker to the second card transport path P2.

The cleaner 4 comprises the cleaning roller 34, made of a rubber material, the surface thereof applied with an adhesive substance and the pressing roller 35 to press facing each other nipping the second card transport path P2.

The turning portion 5 comprises the paired pinch rollers 38 and 39 that are capable of nipping the card C and comprises the rotating frame 40 that rotatingly supports these pinch rollers to rotate and turn centering around the intersecting point of X1. One of the pinch rollers 38, 39 is a driving roller, and the other follows the drive of that roller. The pinch rollers 38 and 39 come into pressing contact with each other on the second transport path p1 when the turning frame 40 assumes a horizontal posture (the state indicated by the solid lines in FIG. 1) and into pressing contact nipping the first card transport path P1 when vertically disposed (the state indicated by the dotted lines in FIG. 1). When the rotating frame 40 is rotated or turned while nipping a card between the pinch rollers 38 and 39, the pinch rollers 38 and 39 rotate together to displace the card C so the rotating or turning action at the turning portion 5 is driven independently to the rotation or inversion of the rotating frame 40 and the rotation of the pinch rollers 38 and 39.

Note that near the turning portion 5 is arranged the unitized transmissive sensor (combined with the slit plate), not shown in the drawings, to detect the rotating angle of the rotating frame 40. Also, to determine the rotating direction of the pinch rollers 38 and 39, a unitized transmissive sensor (combined with a semi-circular plate), also not shown in the drawings, is arranged to detect the position of either of one of the pinch rollers 38 and 39, the rotating angle of the rotating frame 40 being freely set and the direction of the transport of the card C being controlled by the pinch rollers 38 and 39.

Still further, to the image forming apparatus 1 is arranged the image forming portion 9 for forming images to the card C or to the intermediate transfer sheet F using the thermal transfer ink according to image data (positive image data and mirror image data) supplied from the thermal head control portion 19H (see FIG. 4), downstream of the turning portion 5 (the side of the arrow U in FIG. 1) on the first card transport path P1. The image forming portion 9 employs the configuration of a thermal transfer printer and comprises the platen roller 21 that supports the card C when printing to one surface thereof and the thermal head 20 retractably arranged to the platen roller 21. The thermal transfer sheet R is interposed between the platen roller 21 and thermal head 20.

As is shown in FIG. 13A and FIG. 13C, the retracting movement of the thermal head 20 to and from the platen roller 21 is performed by the thermal head sliding drive unit that comprises the holder, not shown in the drawings, that removably supports the thermal head 20, the follower roller 22 that is fastened to the holder, the non-circular thermal head sliding cam 23 that rotates in either direction (the direction of arrow A or the opposite in the drawing) around the cam shaft 24 while following the outer contour of the follower roller 22 and the spring, not shown in the drawings, to press the holder against the thermal head sliding cam 23.

Figure 3A:
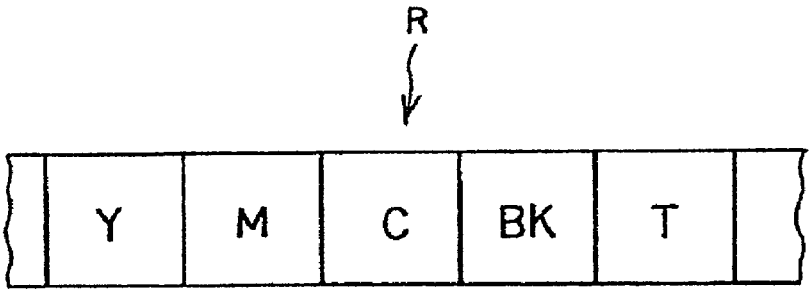
FIG. 3A and FIG. 3B are explanatory drawings of the thermal transfer sheet and intermediate transfer sheet.

As shown in FIG. 3, the thermal transfer sheet R is affixed with the inks of Y (yellow), M (magenta), C (cyan) and Bk (black) in order on the film having widths slightly larger than the length of the card C in the length direction, and comprises a protective layer region T to protect the card C surface formed thereupon by images, after the Bk (black) and in repeated bands in order along the surface.

FIG. 13B and FIG. 13C show the thermal transfer sheet R supplied from the thermal transfer sheet supply portion 14 where the thermal transfer sheet R is wound in a roll, guided by a plurality of guide rollers 53 and the guide plate 25 which is fastened to the holder, not shown in the drawings, while substantially touching the entire surface of the leading edge of the thermal head 20, driven along with the rotational drive of the paired take-up roller 57, to be rolled onto the thermal transfer sheet take-up portion 15. The thermal transfer sheet supply portion 14 and the thermal transfer sheet take-up portion 15 are arranged in positions on both sides of the thermal head 20, the centers thereof mounted onto the spool shaft. To the image forming portion 9, the mark for positioning of the thermal transfer sheet R and the light emitting elements S3 and light receiving elements S4 (hereinafter referred to as light reception sensor S4 below) for detecting the position of the Bk portion on the thermal transfer sheet R are arranged separated from but perpendicular to the thermal transfer sheet R between the guide rollers 53 arranged between the thermal transfer sheet supply portion 14 and the thermal head 20.

Note that to the drive side roller shaft of the paired take-up rollers 57 is mated a gear, not shown in the drawings, the gear meshing with the gear comprising the clock plate not shown in the drawings on the same shaft. Also, near the clock plate is arranged the unitized transmissive sensor, which is not shown, to detect the rotation of the clock plate to control the amount of take-up of the thermal transfer sheet R.

As can be seen in FIG. 13A, the printing position (heating position) Sr of the thermal head 20 interposed by thermal transfer sheet R toward the card C (or the intermediate transfer sheet F) corresponds to the first card transport path P1 on the outer circumference of the platen roller 21. In FIG. 13B, on both sides of the image forming portion 9 are arranged the paired upper rollers composed of by the capstan roller 74 having a constant rotating speed, the pinch roller 75 pressing thereto and the lower paired rollers configured by the capstan roller 78 and pinch roller 79 that sandwich the first card transport path P1 and rotate in synchronization to the moving of the card C in the up and down directions with regard to the printing position Sr.

Figure 3B:
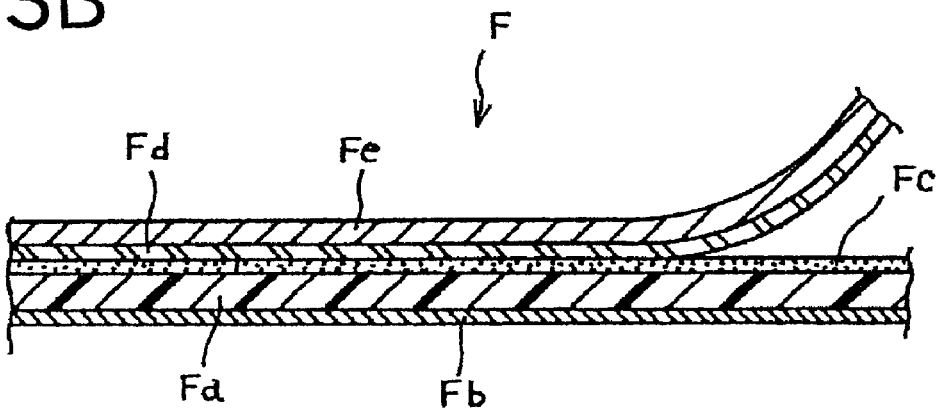

As shown in FIG. 1 and FIG. 13A to FIG. 13C, the intermediate transfer sheet F is trained around the platen roller 21 on the surface facing the thermal head 20. As shown in FIG. 3B, the intermediate transfer sheet F is formed of the base film Fa, the back surface coating layer Fb formed on the back side of the base film Fa, the receptive layer Fe to receive ink, the overcoat layer Fd to protect the receptive layer Fe surface, the peeling surface Fc to promote the peeling of the overcoat layer Fd and the receptive layer Fe thermally joined, and from the base film Fa, the back surface coating layer Fb, the base film Fa, the peeling surface Fc, the overcoat layer Fd and the receptive layer Fe are formed in order in layers from the bottom. The intermediate transfer sheet F is trained with the receptive layer Fe opposing the thermal transfer sheet R and the back coating layer Fb side touching the platen roller 21. At the printing position Sr, the transport speed of the intermediate transfer sheet F when printing to the card C with the direct transfer method (see FIG. 13B) and when forming images on the intermediate transfer sheet (see FIG. 13C), is set to the same speed as that for the transport speed of the thermal transfer sheet R. Furthermore, when printing to the card C using the direct transfer method, the transport speed of the intermediate transfer sheet F and the card C are set to be the same transport speed. Note that to the image forming portion 9, the light emitting element S1 and the light receiving element S2 (called light reception sensor S2 below) for detecting the mark for positioning of the intermediate transfer sheet F are arranged separated from but perpendicular to the intermediate transfer sheet F between the platen roller 21 and guide roller 91. This can be seen in FIG. 13A to FIG. 13C.

Furthermore, as shown in FIG. 1, on the second card transport path P2, downstream of the turning portion 5 on the image forming apparatus 1 are disposed the paired horizontal transport rollers 11 to transport the card C in the horizontal direction, the transfer portion 10 to transfer images formed on the intermediate transfer sheet F at the image forming portion 9 to the card C and the horizontal transport portion 12 comprising the paired discharge rollers 142 to discharge the card C to outside of the frame 2 and a plurality of paired transport rollers to transport the card C in the horizontal direction.

The transfer portion 10 is equipped with the platen roller 50 that supports the card C when transferring from the intermediate transfer sheet F to the card C and the heat roller 45 slidably disposed to the platen roller 50. Built-in to the heat roller 45 is the heating lamp 46 as the heating body to heat the intermediate transfer sheet F. The intermediate transfer sheet F is interposed between the platen roller 50 and heat roller 45.

As is shown in FIG. 14A and FIG. 14B, the advancing and retracting movement of the heat roller 45 with regard to the platen roller 50 is executed by the heat roller elevator drive unit comprising the holder 49 that removably supports the heat roller 45, the follower roller 43 that is fastened to the holder 49, the non-circular heat roller elevator cam 51 to rotate in one direction (the direction of arrow B in the drawing) around the cam shaft 52 while following the outer contour of the follower roller 43 and the spring, not shown in the drawings, to press the holder 49 against the heat roller elevator cam 51.

The intermediate transfer sheet F is supplied from the intermediate transfer sheet supply portion 16, the intermediate transfer sheet F being wrapped thereabout, and is guided by the transport roller 58 that accompanies the follower roller 59, the guide roller 60 and platen roller 21, the guide roller 91, the back tension roller 88 that applies a reverse tension to the intermediate transfer sheet F along with the pinch roller 89, the guide rollers 92 and 44 and the guide plate 47 mounted to the frame configuring the transfer portion 10 arranged on both sides of the heat roller 45. When transferring, the card C is sandwiched between the platen roller 50 and heat roller 45 on the second card transport path P2 and the intermediate transfer sheet F is taken up by the intermediate transfer sheet take-up portion 17 that takes up the intermediate transfer sheet F.

Furthermore, to the transfer portion 10 are arranged the paired transport rollers 48 pressing together to sandwich the second card transport path P2 to transport the card C in the direction of the arrow L along with the paired capstan rollers 141 arranged on the transfer portion 10 on the horizontal transport path 12, that are the drive rollers for the capstan roller, downstream of the paired horizontal transport rollers 11 and upstream of the platen roller 50. Each of the paired rollers of the paired horizontal transport rollers 11, paired transport rollers 48, platen roller 50 and horizontal transport portion 12 downstream of the turning portion 5 on the second card transport path P2 are rotatingly driven by the pulse motor M3 not shown in the drawings via a plurality of gears. Furthermore, in the image forming portion 10, the light emitting element and light receiving element for detecting the mark for positioning of the intermediate transfer sheet F are arranged on either side of the intermediate transfer sheet F between the guide roller 44 and guide plate 47.

Figure 2:
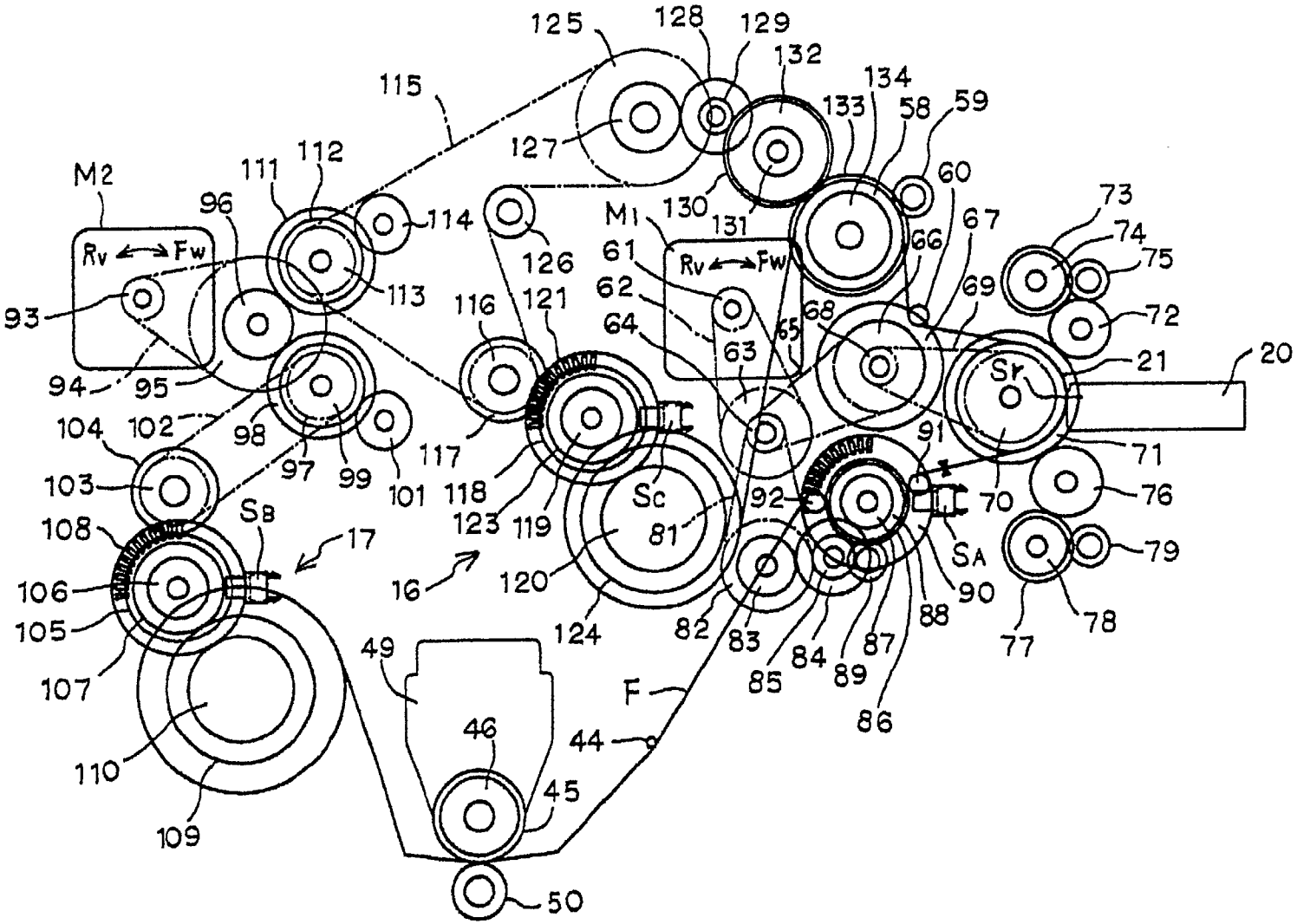
FIG. 2 is a front view showing the card transport mechanism near the intermediate transfer sheet transport mechanism and image forming portion of the image forming apparatus according to an embodiment of the present invention.

As can be seen in FIG. 2, within the region of the frame 2, the first card transport path P1 and the second card transport path P2 shown in FIG. 1, the drive mechanisms that get their driving force from the reversible pulse motor M1 and the reversible pulse motor M2 as the source of drive movement, are arranged. The timing pulley 61 (hereinafter referred to as simply the pulley) is mated to the motor shaft on the pulse motor M1 and an endless timing belt 62 (hereinafter referred to as simply the belt) is trained between the pulley and the pulley 63. To the pulley 63 is mated the pulley 64 having a diameter smaller than the pulley 63.

To the pulley 64, the belt 65 is trained therebetween with the pulley 66. To the pulley 66 shaft is mated the solenoid clutch 67 as the drive interlock switching means. The solenoid clutch 67 interlocks the rotational drive force of the pulley 66 to the pulley 68 mated to the solenoid clutch 67 when transporting the card C in a direct transfer, when directly transferring to the card C by the thermal head 20 and when forming an image on the intermediate transfer sheet F by the thermal head 20. The pulley 70 is mated to the same shaft as platen roller 21 and the belt 69 is trained between the pulley 68 and the pulley 70. Furthermore, to the platen roller 21 shaft is mated the gear 71 having a diameter greater than the platen roller 21. To the gear 71 is meshed the gears 72 and 76. The gear 72 meshes with the gear 73 comprising on the same shaft the capstan roller 74 that presses against the pinch roller 75 and the gear 76 meshes with the gear 77 comprising on the same shaft the capstan roller 78 that presses against pinch roller 79.

Also, another belt, the belt 81, is trained to the pulley 64, transmitting rotational drive force to the pulley 82. To the pulley 82 shaft is mated the gear 83 that meshes with the gear 84. To the gear 84 shaft, the gear 85 having a diameter smaller than the gear 84, is mated, the gear 85 and the gear 86 meshing. The torque limiter 87 is mated to the shaft of the gear 86, rotational drive force is transmitted to the back-tension roller 88 via the torque limiter 87. The pinch roller 89 is pressed against the back-tension roller 88. To the same shaft as the back-tension roller 88 is mated the clock plate 90. While the intermediate transfer sheet F is being fed forward and in reverse, the back-tension roller 88 rotates in synchronization with the intermediate transfer sheet F. Near the clock plate 90 is disposed the unitized transmissive sensor SA to detect the amount of rotation of the clock plate 90 to control the amount of transport (the amount fed and the amount returned) of the intermediate transfer sheet F.

To the motor shaft of the pulse motor M2 is mated the pulley 93. The belt 94 is trained between the pulley 93 and the pulley 95. The gear 96 is mounted to the pulley 95 shaft.

In the counterclockwise direction, the drive from the gear 96 is transmitted and in the clockwise direction meshes with the one-way gear 97 mated to the shaft that is the pulley (freely rotates). To the shaft on the one-way gear 97, the gear 98 and pulley 99 are mated, the gear 98 meshes in the clockwise direction with the one-way gear 101 that is a pulley and locked in the counterclockwise direction. To the pulley 99, the belt 102 is trained therebetween with the pulley 103. To the gear 103 shaft, the gear 104 is mated, the gear 104 meshes with the gear 105. To the gear 105 shaft is mated the torque limiter transmitting rotational drive force to the gear 107 via the torque limiter 106. To the same shaft as the gear 107 is mated the clock plate 108. The gear 107 meshes with the gear 109 that is mated to the take-up spool shaft 110 to take up the intermediate transfer sheet F. Near the clock plate 108 is disposed the unitized transmissive sensor SB to detect the amount of rotation of the take-up spool shaft 110, via the rotation of the clock plate 108, and to detect any breakage in the intermediate transfer sheet F by detecting the rotation of the take-up spool shaft 110.

Also, the gear 96 meshes with the one-way gear 111 mated to the shaft that is the pulley in the counterclockwise direction, the drive from the gear 96 being transmitted in the clockwise direction. To the shaft on the one-way gear 111, the gear 112 and pulley 113 are mated, the gear 112 meshes in the clockwise direction with the one-way gear 114 that is the pulley and locked in the counterclockwise direction. To the pulley 113 the belt 115 is trained therebetween the pulley 116 and the pulley 125. Furthermore, to maintain a constant tension on the belt 115, the tension roller 126 is disposed between the pulley 116 and the pulley 125 which are connected by the belt 115. To the gear 116 shaft, the gear 117 is mated, the gear 117 meshes with the gear 118. To the gear 118 shaft is mated the torque limiter transmitting rotational drive force to the gear 123 via the torque limiter 119. To the same shaft as the gear 123 is mated the clock plate 121. The gear 123 meshes with the gear 124 that is mated to the supply spool shaft 120 to supply the intermediate transfer sheet F. Near the clock plate 121 is disposed the unitized transmissive sensor SC to detect the amount of rotation of the supply spool shaft 120, via the rotation of the clock plate 121, and to detect any breakage in the intermediate transfer sheet F by detecting the rotation of the supply spool shaft 120. The intermediate transfer sheet supply portion 16 is mounted to the supply spool shaft 120, the intermediate transfer sheet take-up portion 17 being mounted to the take-up spool shaft 110.

On the other hand, the drive from the pulley 113 is transmitted also to the pulley 125, via the belt 115. To the gear 125 shaft, the gear 127 is mated, the gear 127 meshes with the gear 128. Still further, the drive is transmitted to the gear 130 via the gear 129 disposed on the same shaft as the gear 128. To the pulley 130 shaft is mated the solenoid clutch 131. The solenoid clutch 131 interlocks the rotation drive force of the gear 130 to the gear 131 via the gear 132 mated to the shaft of the solenoid clutch 131 only when returning the intermediate transfer sheet F (Rv). To the gear 133 shaft is mated the torque limiter 134, the rotational drive force transmitted to the transport roller 58 to transport the intermediate transfer sheet F via the torque limiter 134. Note that the speed of transporting of the intermediate transfer sheet F by the supply spool shaft 120, the platen roller 21 and the transport roller 58 when the aforementioned solenoid clutch 131 drive is interlocked, is set so that the speed of the supply spool shaft 120 is greater than the transport roller 58 which is greater than the platen roller 21. Regarding the torque control, it is set so that the platen roller 21 is greater than the transport roller 58 which is greater than the supply spool shaft 120.

The feeding (Fw) and reverse (Rv) of the intermediate transfer sheet F are primarily performed by switching the direction of rotation of the pulse motor M2. When forming images on the intermediate transfer sheet F while undergoing the take-up return (Rv), the transport speeds for the intermediate transfer sheet F by the supply spool shaft 20, the platen roller 21 and the back-tension roller 88 are set so that the supply spool shaft 20 is greater than the platen roller 21 which is greater than the back-tension roller 88. For that reason, when separating the thermal head 20 and feeding the intermediate transfer sheet F, drive is cut by the solenoid clutch 67 to prevent slackening of the intermediate transfer sheet F.

As can be seen in FIG. 1, formed on the line extended to the direction of arrow L on the second card transport path P2 in the frame 2 is the discharge roller 27 to discharge the card C whose printing has been completed, to outside of the frame 2. Below the discharge outlet 27 is removably mounted from the frame 2 the stacker 13 for stacking a stack of the card C. Note that, the unitized transmissive sensor S5 is arranged between the cleaner 4 and the transfer portion 5, the transmissive sensor S6 is arranged on the capstan roller 78 side near the turning portion, the unitized transmissive sensor S7 is arranged between the capstan roller 78 and the thermal head 20, the unitized transmissive sensor S8 is arranged on the side of the paired horizontal transport rollers 11 near the paired transport rollers 48, the unitized transmissive sensor S9 is arranged on the paired discharge rollers 142 side near the paired rollers that have no drive arranged between the paired capstan rollers 141 and the paired discharge rollers 142, the unitized transmissive sensors S10 (not shown in the drawings) are between the horizontal transport portion 12 and discharge outlet 27, to detect the leading edge or the trailing edge of the card C being transported along the first card transport path P1 or the second card transport path P2. Note that in the following explanation, the card C is transported in the directions of arrows U and D as well as the direction of arrow L so as a reference for the direction of transport of the card C, uniformly, the leading edge of the direction of the transport of the card C shall be the leading edge, and the trailing edge of the direction of the transport of the card C shall be the trailing edge.

Furthermore, as shown in the FIG. 1, the image forming apparatus 1 is equipped in the frame 2 with the power supply unit 18 that converts drive/operable direct current electric power for the each mechanism and control unit from commercial alternating current power, the control unit 19 that controls the entire operation of the image forming apparatus 1, and for displaying the status of the image forming apparatus 1, according to the information from the control unit 19, a touch panel 8 that allows an operator to input instructions to the control unit 19, on the upper portion of the frame 2.

Figure 4:
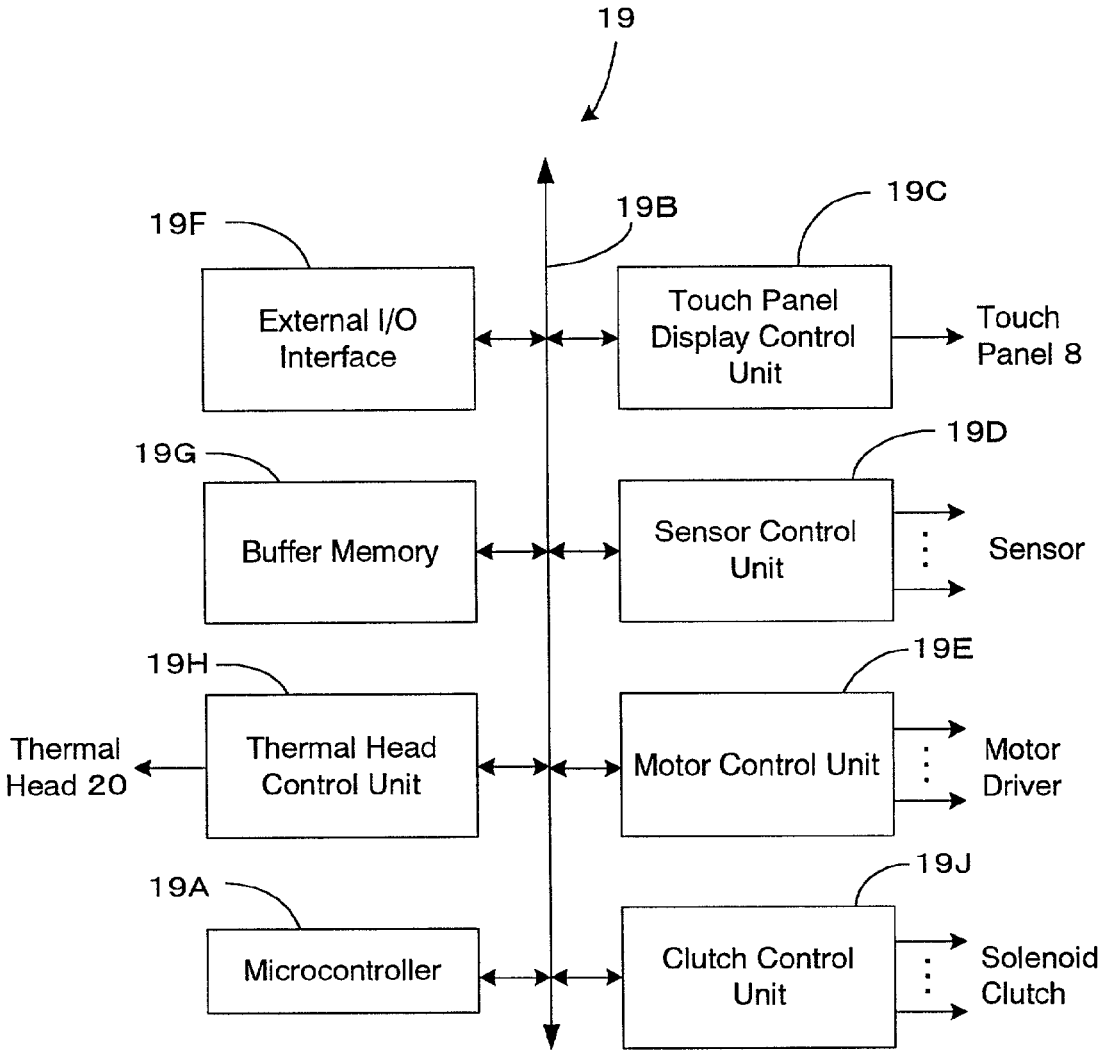
FIG. 4 is a block diagram of the general configuration of the image forming apparatus control unit according to the embodiment of the present invention.

As is illustrated in FIG. 4, the control unit 19 comprises the microcontroller 19A that controls the processing on the image forming apparatus 1. The microcontroller 19A is composed of a CPU that operates under a fast clock speed as its central processing unit, a ROM written with control instructions for the image forming apparatus 1 and an internal bus to connect with the RAM that works using the work area on the CPU and these together.

The external bus 19B is connected to the microcontroller 19A. To this external bus 19B are connected the touch panel display operation control portion 19C to control the instructions and displays of the touch panel 8, the sensor control portion 19D to control the signals from each of these sensors, the motor control unit 19E to control the motor driver that outputs drive pulses to each of the motors, the I/O interface 19F for communications with the external computer and image forming apparatus 1, the buffer memory 19G to temporarily store image information for printing to the card C, the thermal head control unit 19H to control the thermal energy of the thermal head 20 and the clutch control unit 19J to output ON and OFF control signals to the solenoid clutch. The touch panel display operation control unit 19C, the sensor control unit 19D, the thermal head control unit 19H and the clutch control unit 19J are each connected to the touch panel 8, the sensors including Sa to Sc and S1 to S10, the drivers including the pulse motor drivers of M1 to M3, thermal head 20 and the solenoid clutches 67 and 131.

Next, in reference to the flowcharts, regarding the action of the first embodiment of the image forming apparatus 1, single color images, such as cautions, are formed on one side of the card C using the direct transfer method, color images, such as a photograph, name, and associations of the card owner, on the other side of the card C using the indirect transfer method. Note image information received via the external I/O interface 19F and buffer memory 19G from an external computer is converted to positive data and mirrored image data and stored in the RAM.

The CPU displays the initial screen on the touch panel via the touch panel display operation control unit 19C. The touch panel 8 (or the display screen for the external computer), at this point displays the mode buttons to set for the single side printing mode that prints to one side of the card C, or the duplex printing mode that prints to both sides of the card C, a clear button to clear the mode set by the mode setting buttons, the start button to start printing with the mode set on the image forming apparatus 1 and it displays if the image forming apparatus 1 is in standby, is ready to print or how many cards have been processed. When an operator enters a mode with the mode setting button, and presses (touches) the start button, the image forming routine is executed to form images on the card C.

Figure 5:
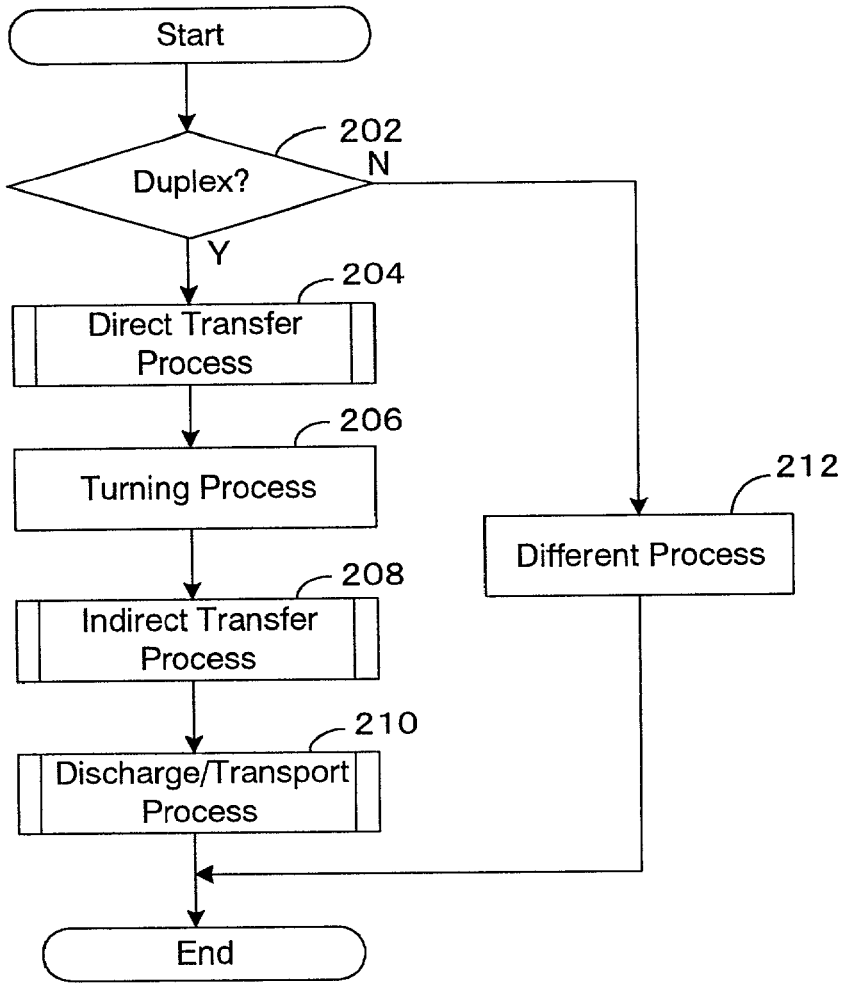
FIG. 5 is an image forming routine flowchart executed by the image forming apparatus control unit CPU according to the first embodiment of the present invention.

As shown in FIG. 5, in the image forming routine, first at step 202, it determines whether or not the mode is set to duplex printing mode. If negative, at step 204, it executes the direct transfer process routine to form images using the direct transfer method on one side of the card C.

Figure 6:
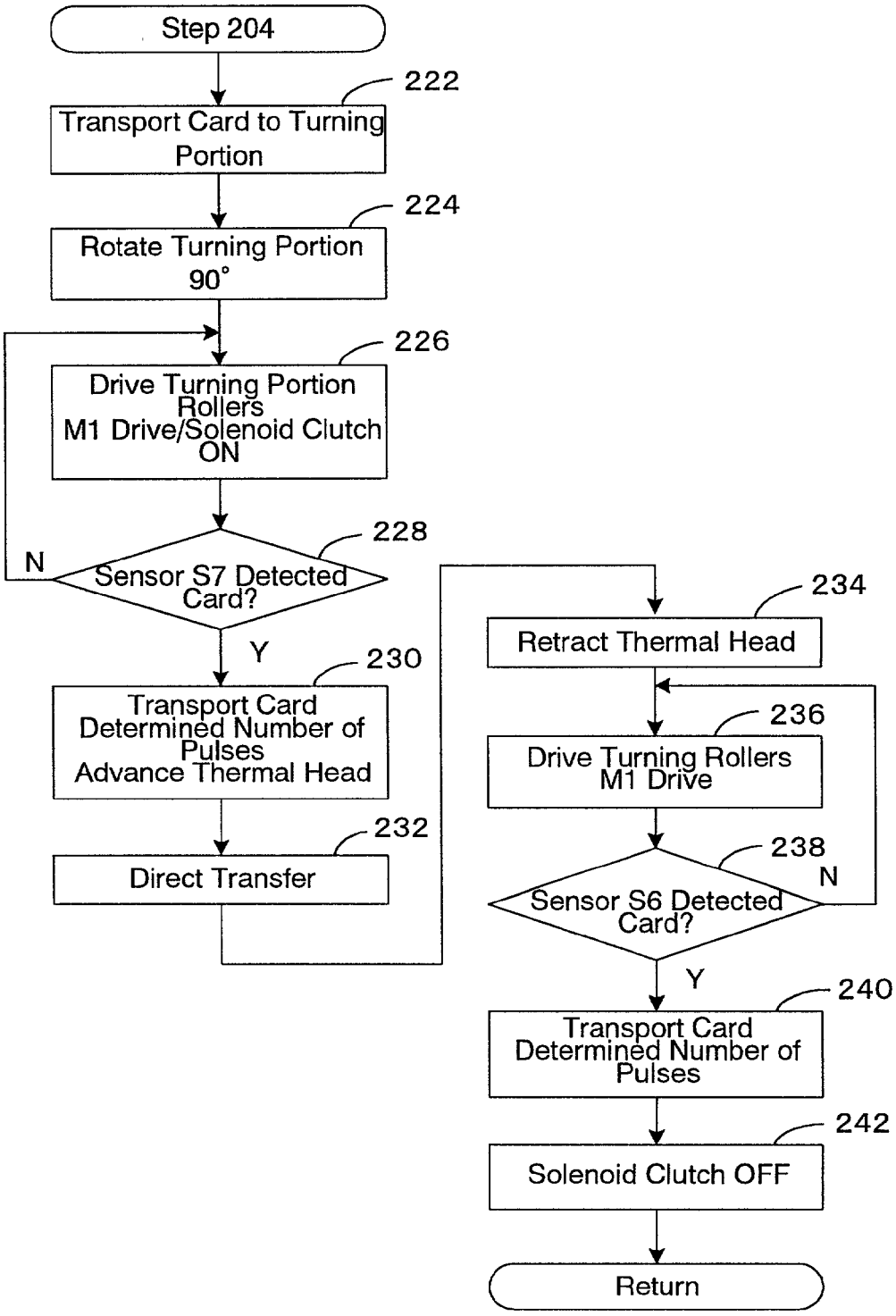
FIG. 6 is a flowchart of a subroutine of the direct transfer process showing the details of step 204 of the image forming routine.

As shown in FIG. 6, with the direct transfer routine at step 222, the action of the card supply portion 3 arranged on the second card transport path P2, the cleaner 4 and each of the rollers on the turning portion 5 transport the card C from the card supply portion 3 to the direction of the arrow L and nips the card C by the pinch rollers 38 and 39 in the turning portion 5. In other words, by rotating the kick roller 31 on the card supply portion 3, the bottommost card C in the card stacker is fed to the second card transport path P2 whereat both sides thereof are cleaned by the cleaning roller 34 on the cleaner 4. When it is detected that the leading edge of the card C has been detected by the unitized transmissive sensor, not shown in the drawings, arranged between the cleaner 4 and the transfer portion 5, the rotation of the kick roller 31 on the card supply portion 3 is stopped. The card C is stopped after being transported a determined number of pulses after passing the unitized transmissive sensor S5 to the turning portion 5 (the rotational drive of the pinch rollers 38 and 39 is also stopped) and the turning portion 5 nips both ends of the card C.

Next, at the step 224, the turning portion 5 is rotated 90° and becomes vertically oriented (see the dotted lines in FIG. 1) to transport the card C in the direction of the arrow U over the first card transport path P1. Next, at step 226, while rotatingly driving the pinch rollers 38 and 39, the rotating drive of the pulse motor PM1 starts to the pulse motor M1 motor driver and solenoid clutch 67 transmits drive force from the pulse motor M1 to the platen roller 21. Through this, the rotational drive of the pinch rollers 38 and 39, the platen roller 21, and the capstan rollers 74 and 78 is started, the card C begins its transport to the image forming portion 9 along the first card transport path P1. Also, the intermediate transfer sheet F begins transport to the intermediate transfer sheet supply portion 16 (a rewind).

At the next step 228, the unitized transmissive sensor S7, not shown in the drawings, arranged between the capstan roller 78 and the thermal head 20 determines if the leading edge of the card C has been detected. If negative, it returns to the step 226 and continues the transport of the card C to the image forming portion 9. If affirmative, at step 230, it transports the leading edge of the card C in the direction of arrow U a determined number of pulse so the leading edge of the card C reaches the printing position Sr. The pinch rollers 38 and 39 on the turning portion 5 stop rotating at the point where the unitized transmissive sensor S6, not shown in the drawings, arranged between the turning portion 5 and the image forming portion 9, detects the trailing edge of the card C. During that time, the thermal head 20 is positioned away from the platen roller 21 (see FIG. 13A) and the thermal transfer sheet R is fed a determined distance to the printing position Sr, for example at the starting edge of Bk (black). Such control enables detecting the trailing edge of the Bk (black) portion of the thermal transfer sheet R by the light emitting sensor S4, and detection of the rotation of the clock plate, not shown in the drawings, disposed near the paired take-up rollers 57 by the unitized transmissive sensor, not shown in the drawings, to detect the distance from the trailing edge of the Bk (black) portion having a predetermined width on the thermal transfer sheet R, to starting edge of the next consecutively repeated Bk (black) portion on the thermal transfer sheet R. Next, at step 230, it starts the rotation of the thermal head sliding cam 23 in the direction of arrow A. This supports the other side of the card C at the platen roller 21 interposed therebetween by the intermediate transfer sheet F, one side touching the thermal head 20 interposed therebetween by the thermal transfer sheet R.

Continuing, at step 232, images are formed on the one side of the card C using the direct transfer method. The CPU pre-converts image information into thermal energy, via the thermal head control unit 19H and sends the positive image data to the thermal head 20 with the determined coefficients relating to the type of the card C added to that thermal energy. The printing elements of the thermal head 20 are heated according to the positive image data. The pulse motor M1 drive rotates the platen roller 21 in the counterclockwise direction. In synchronization to that, the thermal transfer sheet R is taken-up by the thermal transfer sheet take-up portion 15 and images such as cautions are formed (printed) in Bk (black) by direct transfer to one side of the card C. Note that the intermediate transfer sheet F is transported at the same speed as the thermal transfer sheet R and the card C.

At the next step 234, the thermal head sliding cam 23 is rotated in the direction opposite to the arrow A to retract the thermal head 20 from the card C. At step 236, after reversingly driving the pinch rollers 38 and 39, the reverse drive of the pulse motor M1 is started to reversingly rotate the platen roller 21 and the capstan rollers 74 and 78, transporting the card C in the direction of the arrow D.

At step 238, it determines if the trailing edge of the card C has been transported to the position of the unitized transmissive sensor S6, not shown in the drawings. If the decision is negative, it returns to step 236 and continues to transport the card C in the direction of the arrow D. If affirmative, at the next step 240, it transports the card C a determined number of pulses further in the direction of the arrow D. Next, at step 242, the drive of the pulse motor M1 is stopped and the coupling of the platen roller 21 to the solenoid clutch 67 is stopped. The reverse rotation of the pinch rollers 38 and 39 is stopped to nip the card C in the pinch rollers 38 and 39 while the turning portion 5 is vertically oriented to complete the direct transfer process sub-routine. It then proceeds to step 206. Note that in direct transfer, as shown in FIG. 14A, the heat roller 45 on the transfer portion 10 maintains a separated state from the platen roller 50.

At step 206, the vertically oriented turning portion 5 is rotate 90° to allow the card C positioned on the first card transport path P1 to be transported in the direction of the arrow L on the second card transport path P2. This positions the card C with the other side upward, on the second card transport path P2.

Next, at step 208, the indirect transfer process sub-routine for forming images on the other side of the card C by the indirect transfer method is executed.

Figure 7:
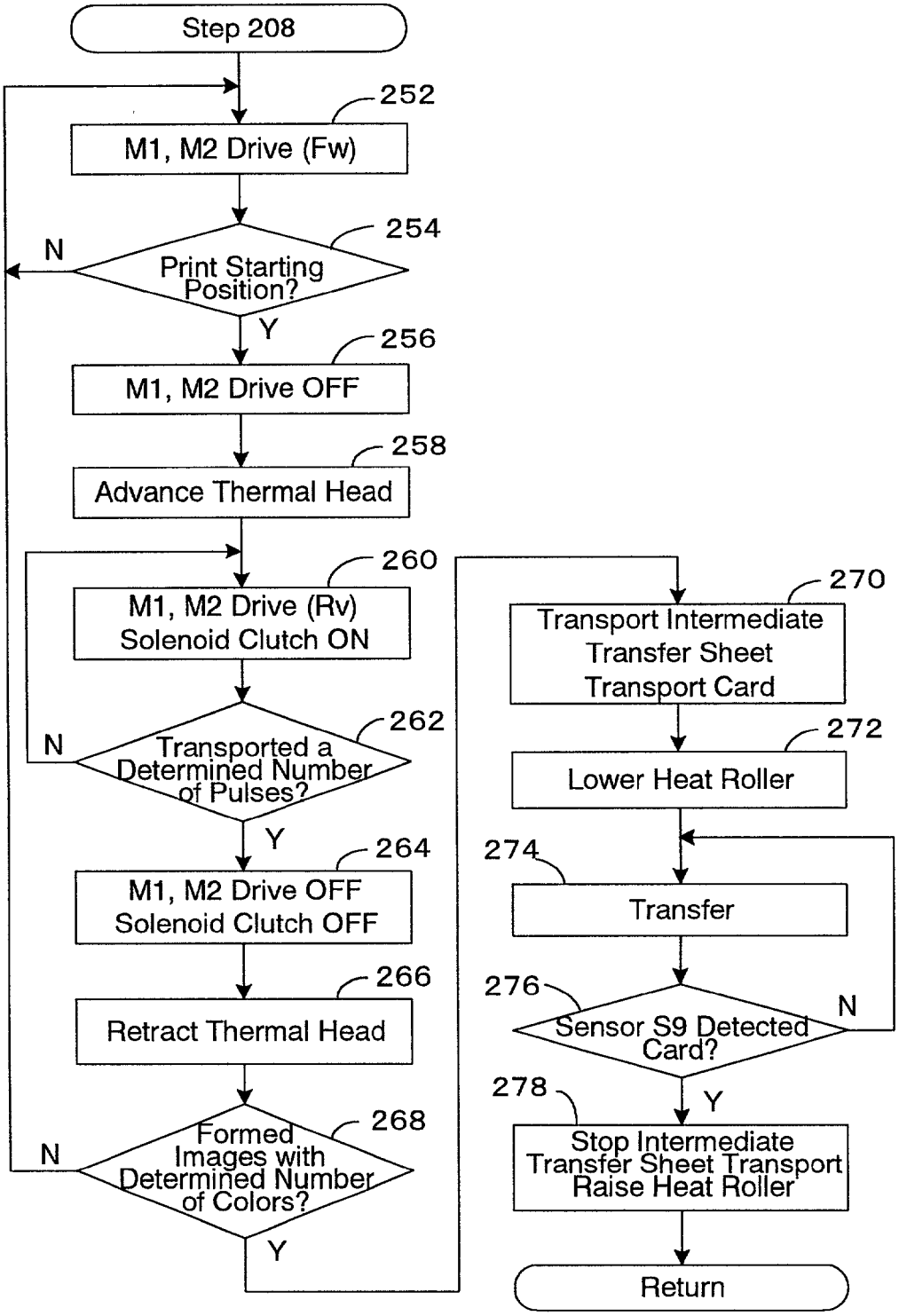
FIG. 7 is a flowchart of a subroutine of the indirect transfer process showing the details of step 208 of the image forming routine.

Referring to FIG. 7, in the indirect transfer process sub-routine, initially, at step 252 the pulse motors M1 and M2 rotate in the feed direction (Fw). In the step 254, the mark for positioning formed on the intermediate transfer sheet F is recognized by monitoring the light reception sensor S2 and by detecting the amount of rotation of the clock plate 90 connected to the back-tension roller 88 that reversibly rotates the feeding and returning of the intermediate transfer sheet F always as a single unit, it is determined whether or not that the intermediate transfer sheet F has been transported to the printing starting position. If it is a negative decision, it returns to step 252 and continues transporting the intermediate transfer sheet F. If the decision is affirmative, the drive of the pulse motors M1 and M2 are stopped at step 256. During that time, the thermal head 20 is positioned away from the platen roller 21 and the thermal transfer sheet R is fed a determined distance to the printing position Sr, for example at the starting edge of Y (yellow). Such control enables detecting the trailing edge of the Bk (black) portion of the thermal transfer sheet R by the light emitting sensor S4, and detection of the rotation of the clock plate, not shown in the drawings, disposed near the paired take-up rollers 57 by the unitized transmissive sensor, not shown in the drawings, to detect the distance from the trailing edge of the Bk (black) portion having a predetermined width on the thermal transfer sheet R, to the Y (yellow) portion on the thermal transfer sheet R.

Next, at step 258, the thermal head sliding cam 23 is rotated in the direction of the arrow A to touch the thermal head 20 against the platen roller 21 interposed therebetween by the thermal transfer sheet R and the intermediate transfer sheet F. Next, at step 260, while rotating the pulse motor M1 and the pulse motor M2 in the reverse (Rv) direction, the platen roller 21 is rotated in the counterclockwise direction by interlocking the solenoids 67 and 131 thereby rotating the transport roller 58 in the counterclockwise direction. This starts the forming of the image using the color Y (yellow) on the intermediate transfer sheet F. In other words, by the thermal head 20 heating the Y (yellow) ink layer on the thermal transfer sheet R, it starts forming the image on the receptive layer FE on the intermediate transfer sheet F. The driving force provided by the pulse motor M1 rotates the platen roller 21 in the counterclockwise direction and the driving force of the pulse motor M2 takes up the intermediate transfer sheet F by the intermediate transfer sheet supply portion 16 and in synchronization to that the thermal transfer sheet R is taken up by the thermal transfer sheet take-up portion 15.

At step 262, by determining whether or not the pulse motor M1 has rotatingly driven the determined number of pulses that correspond to the size of the length direction of the image formed on the intermediate transfer sheet F, it is determined whether or not the forming of the image on the intermediate transfer sheet F has been completed. When it is negative, it returns to step 260 and continues forming the image on the intermediate transfer sheet F. If affirmative, along with stopping the drive of both the pulse motor M1 and M2 at the step 264, it releases the interlock of the solenoids 67 and 131 on the platen roller 21 and transport roller 58. Note that through the control portion 19 thermal control unit 19H, the thermal energy applied to the thermal head 20 when forming images on the intermediate transfer sheet F is controlled to be lower than the thermal energy applied to the thermal head 20 when directly transferring to one side of the card C and that the specific heat of the base film Fa on the intermediate transfer sheet F itself is a lower specific heat than the card C. Operations of such thermal energy can be performed by changing coefficients to the thermal energy. Also, the data sent to the thermal head 20 from the thermal head control portion 19H varies from the aforementioned step 232 when forming images on the intermediate transfer sheet F. It is mirrored data.

At step 266, the thermal head sliding cam 23 rotates to retract the thermal head 20 from the platen roller 21 and at step 268, it determines whether or not the forming of the image for the prescribed colors (YMC) has been completed. When it is negative, it returns to step 252 to form the image over the color already formed on the receptive layer on the intermediate transfer sheet F (for example, Y) with the next color (for example, M). If affirmative, in other words, if it is determined that the forming of the image using the colors YMC has been completed and it proceeds to step 270. This forms the mirrored image of the colors for the personal information, including a photographic image of the card owner, on the image forming area on the intermediate transfer sheet F.

At step of 270, the pulse motor M2 drives to transport the intermediate transfer sheet F (the image forming area on the intermediate transfer sheet F) according to the rotating amount of the clock plate connected to the back-tension roller 88, to the position of the heat roller 45 already separated from the platen roller 50. When transporting, by monitoring the output from the light receiving sensor arranged between the guide roller 44 and the guide plate 47 in the transfer portion 10, it detects the mark for positioning the intermediate transfer sheet F making it possible to reset the amount of transport at this point to improve the accuracy of the transport.

Also, at step 270, in parallel to the transporting to the transfer portion 10 on the intermediate transfer sheet F, the card C, nipped by the turning portion 5 at step 206, is transported in the direction of arrow L in FIG. 1, along the second card transport path P2 until the leading edge thereof abuts the heat roller 45. Specifically, while rotatingly driving the pinch rollers 38 and 39 on the turning portion 5, the pulse motor M3, not shown in the drawings, is driven to rotate the paired horizontal transport rollers 11, the paired transport rollers 48 and each of the rollers on the horizontal transport portion 12. When the unitized transmissive sensor S8, not shown in the drawings, arranged on the side of the paired horizontal transport rollers 11 near the paired transport rollers 48 detects the leading edge of the card C, it transports the card C further in the direction of the arrow L a determined number of pulses. This transports the leading edge of the card C to the position touching the heat roller 45. Note that the point at which the unitized transmissive sensor S8, not shown in the drawings, detects the leading edge of the card C, the rotational drive of the pinch rollers 38 and 39 is stopped.

Next, at step of 272, the heat roller elevator cam 51 is rotated in the direction of the arrow B and shifts the heat roller 45 from being separated from the platen roller 50 to touching the platen roller 50 (see FIG. 14), then stops the rotation of the heat roller elevator cam 51. At this point, the leading edge of the card C touches the heat roller 45, a side of the card C being supported by the platen roller 50 and the intermediate transfer sheet F interposed between the other side of the card C and heat roller 45.

Next, at step 274, images formed on the reception layer Fe on the intermediate transfer sheet F are indirectly transferred to the other surface of the card C at the image forming portion 9 using the thermal transfer of the heat roller 45. To describe the operations that occur here at step 274 in more detail, the card C, one side thereof supported by the platen roller 50 that rotates in the counterclockwise direction, is touched to the heat roller 45 with the other surface interposed by the intermediate transfer sheet F and is transported in the direction of the arrow L. The peeling layer Fc on the intermediate transfer sheet F is peeled away from the base film Fa by the heat of the heating lamp 46 and the layer Fe formed thereupon with an image and the overcoat layer are transferred to the other side of the card C as a single body. In synchronization to this transfer, the intermediate transfer sheet F is taken up by the intermediate transfer sheet take-up portion 17. During this time, at step 276, by monitoring whether or not the leading edge of the card C is positioned at the unitized transmissive sensor S9 arranged on the paired discharge roller 142 side near the paired rollers that have no drive arranged between the capstan rollers 141 and the paired discharge rollers 142, it determines whether or not the intermediate transfer has been completed. If uncompleted, it returns to step 274 and continues the indirect transfer. If indirect transfer has been completed, it proceeds to the next step of 278. Note that the transport of the card C and the intermediate transfer sheet F during indirect transfer are the same speed, at step 270, the transport speed of the intermediate transfer sheet F is set to be slower.

At step 278, by stopping the drive of the pulse motors M2 and M3, the transport of the intermediate transfer sheet F (rewinding to the intermediate transfer sheet take-up portion 17) and the transport of the card C in the direction of the arrow L are stopped. The heat roller elevator cam 51 is re-rotated to retract the heat roller 45 from the platen roller 50 completing the intermediate transfer process sub-routine. It then proceeds to step 210, shown in FIG. 5. This transfers mirrored images of color, including a photograph of the card owner, formed on the intermediate transfer sheet F, to the other side of the card C affixing a positive color image to the other side of the card C.

At step 210, while discharging the card C formed on both sides with images, to outside of the image forming apparatus 1, it prosecutes the discharge/transport sub-routine that transports unused portions adjacent to the area where images were formed on the intermediate transfer sheet F, to the image forming portion 9 in preparation for processing the next card C.

Figure 8:
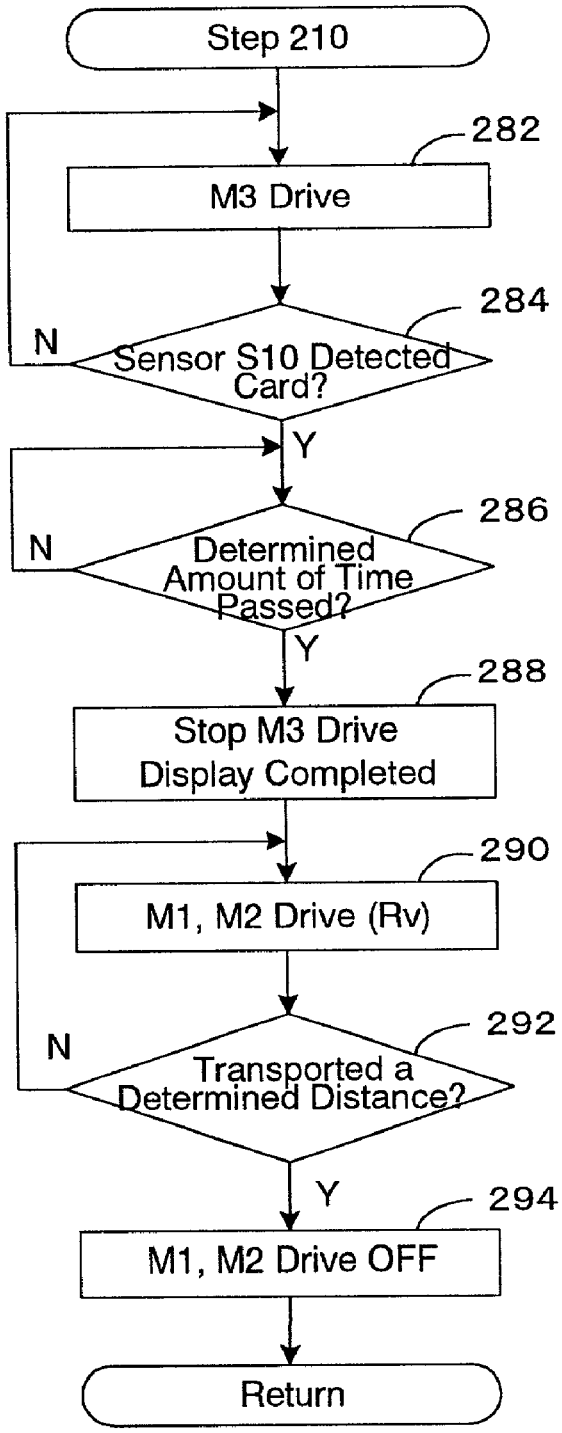
FIG. 8 is a flowchart of a subroutine of the discharge and transport processes showing the details of step 210 of the image forming routine.

As shown in FIG. 8, first at the transport/discharge subroutine, the pulse motor M3 is driven to transport the card C further in the direction of arrow L along the second card transport path P2 at step 282. At step 284, it determines whether or not the unitized transmissive sensor S10, not shown in the drawings, arranged between the horizontal transport portion 12 and the discharge outlet 27 has detected the leading edge of the card C. If negative, it returns to step 282 to transport the card C further for discharge. If affirmative, it continues transporting the card C a predetermined amount of time at step 286 until the card C is completely discharged to outside of the image forming apparatus 1. This discharges the card C to the stacker 13 via the discharge outlet 27. Next, at step 288, the rotating drive of the pulse motor M3, not shown in the drawings, is stopped at which point the number of cards that have been processed or the completion of the processing of cards is displayed on the touch panel 8.

At step 290, the pulse motors M1 and M2 are driven in reverse. At step 292, the unitized transmissive sensor SA, described above, determines whether or not the intermediate transfer sheet F has been transported the determined distance. If negative, it returns to step 290 and continues to transport the intermediate transfer sheet F. If affirmative, it stops the drives of the pulse motors M1 and M2 at the next step 294 and completes the discharge/transport subroutine and the image forming routine.

On the other hand, when there is a negative determination at step 202 shown in FIG. 5, in other words, when in single side printing mode, at step 212, a different process for forming images on a single side of the card C is executed using the direct transfer method or the indirect transcription transfer method is executed, and the image forming routine is finished. In this other process, only the direction of transportation of the card C before and after direct transfer or indirect transfer is different, but processing substantially similar to the direct transfer process subroutine shown in FIG. 6 or the indirect transfer process subroutine shown in FIG. 7 is executed. This enables attaining card C formed thereupon with images on one side with the direct transfer and with images on the other side formed by the indirect transfer method.

Note that when directly transferring images to one side of the card C in this other process, often times color images containing the three colors of YMC are specified. In such cases, the forming of images using only Bk (black) does not occur, and the forming of images using the three colors of YMC, described below, is specified. At step 230, the thermal transfer sheet R is fed a determined distance to the printing position Sr, for example to the starting edge of Y (yellow). At step 232, images are formed on the card C using the three colors of YMC. Specifically, the pulse motor M1 drive rotates the platen roller 21 in the counterclockwise direction. In synchronization to that, the thermal transfer sheet R is taken-up by the thermal transfer sheet take-up portion 15 and the Y (yellow) image is formed (printed) by direct transfer to the card C. It rotates the thermal head sliding cam 23 in the direction opposite to the arrow A when the forming of the image by the Y (yellow) portion is completed and the thermal head 20 is retracted from the card. The CPU starts reversingly driving the pulse motor M1 after the thermal head 20 is retracted. This reverse rotates the platen roller 21, the capstan rollers 74 and 78, and the card C is transported in the direction of the arrow D. The CPU stops the reverse rotational drive of the pulse motor M1 after the trailing edge of the card C passes the position of the unitized transmissive sensor S7, not shown in the drawings and the card C has been transported a determined number of pulses. Also, to print with the next die M (magenta), the CPU forward drives the pulse motor M1. After the leading edge of the card C is detected by the unitized transmissive sensor S7, not shown in the drawings, the CPU transports the card C in the direction of the arrow U for a determined number of pulses to the printing position Sr. During that time, the CPU feeds a minute amount of the thermal transfer sheet R until the leading edge of the next color M (magenta) is positioned at the print starting position Sr. Then, by rotating the thermal head sliding cam 23 in the direction of the arrow A, the thermal head 20 is pressed against the card C, therebetween interposed by the thermal transfer sheet R. The thermal head 20 forms the image of M (magenta) overlaying the previous color of Y (yellow) on the card C. The CPU, repeats the aforementioned processes in order to overlap images in the YMC inks on the surface of the card C.

The following shall describe the actions of the image forming apparatus 1 according to the first embodiment.

The image forming apparatus 1 according to the first embodiment comprises an image forming portion 9 that forms images onto the card C or the intermediate transfer sheet F and the transfer portion 10 that transfers to the card C images formed on the intermediate transfer sheet F, so it is possible to print with both the direct transfer and indirect transfer methods of printing. Furthermore, because it is possible in such situations to print to a single side or both sides by electing either of direct transfer or indirect transfer, the convenience to users is further improved.

Also, with the first embodiment of the image forming apparatus 1, to print to both sides of the card C, the card C is transported to the image forming portion 9 (the printing position Sr at the image forming portion 9) in the direct transfer process sub-routine (steps 222 to 230) to form images on one side of the card C at the image forming portion 9 (step 232). After completing the execution of the direct transfer process sub-routine, the intermediate transfer sheet F is transported to the image forming portion 9 with the indirect transfer process sub-routine (steps 252 to 256), images are formed on the intermediate transfer sheet F at the image forming portion 9 (steps 258 to 268) and the intermediate transfer sheet F is transported to the transfer portion 10 while the card C is also transported to the transfer portion 10 (step 270) where images formed on the intermediate transfer sheet F are transferred to the other side of the card C (steps 272 to 278). Therefore, to print to both sides of the card C with the image forming routine, images such as cautions, etc., reformed using the direct transfer method to the one side of the card C, and images such as photographs of the card owner are formed in color using the indirect transfer method so by switching the image forming method for each side of the card C images can be formed to the side of the card C using the optimum image forming method (without indirectly transferring images to one side) using only an indirect transfer on the other side that requires printing over the entire surface to reduce the running cost of the intermediate transfer sheet F.

Furthermore, the image forming apparatus 1 is equipped with the turning portion 5 that turns the card C with regard to the second card transport path P2 (steps 224 and 206 in 90° rotations) to consecutively execute the indirect transfer process sub-routine after the direct transfer process sub-routine without the card C discharging from the image forming apparatus 1 so it can protect the security of the personal information of the card owner, such as their photograph, name or associated groups, in normal operating circumstances of the image forming apparatus 1 and because the forming of images of personal data to the other side of the card C is performed after direct transfer, even if the discharge of the card C from the image forming apparatus when the forming of images to both sides is not yet completed, is unavoidable because of machine failure or a power outage, the card C only printed with cautions is discharged, so the security of protecting personal information in emergency situations on the image forming apparatus 1 is ensured.

Still further, because with the image forming apparatus 1, images can be formed to the one side of the card C and to the intermediate transfer sheet F using the image forming portion 9 so the image forming apparatus 1 can be more compact and can lower costs.

Note that in the first embodiment, an example forming an image, such as cautions, using a single color (monochrome) on one side of the card C was shown at step 232. However, according to the objective of the print, as described for the other process at step 212, images can be formed using a plurality of color scales, or conversely, the images of steps 258 to 268 printed using only a single color.

The following shall describe the operations of the image forming apparatus 1 according to the second embodiment of this invention focusing on the CPU of the microcontroller 19A in the control unit 19, in reference to the flow chart. Note image information received via the external I/O interface 19F and buffer memory 19G from an external computer is converted to a positive data and mirrored image data and stored in the RAM.

The CPU displays the initial screen on the touch panel via the touch panel display operation control unit 19C. The touch panel 8 (or the display screen for the external computer), at this point displays the mode buttons for single side mode or duplex mode printing, the clear button to mode set by the mode setting button, the start button to start printing with the mode selected for the image forming apparatus 1 and displays if the image forming apparatus 1 is in standby, is ready to print or how many cards have been processed. When an operator enters a mode with the mode setting button, and presses (touches) the start button, the image forming routine is executed to form images on the card C.

Figure 9:
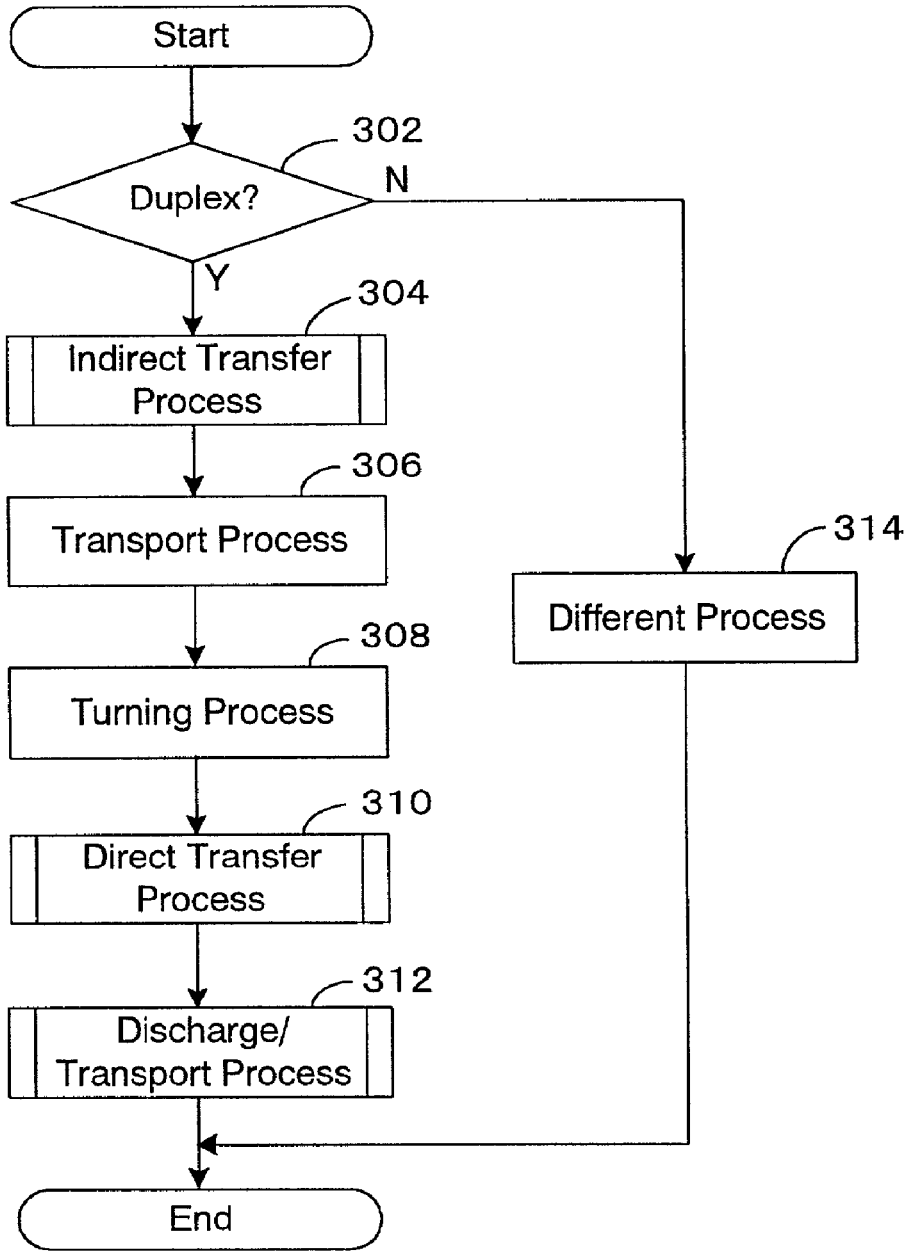
FIG. 9 is a image forming routine flowchart executed by the image forming apparatus control unit CPU according to the second embodiment of the present invention.

As shown in FIG. 9, in the image forming routine, first at step 302, it determines whether or not the mode is set to duplex printing mode. If negative, at step 304, it executes the indirect transfer process routine to form images using the indirect transfer method on one side of the card C.

Figure 10:
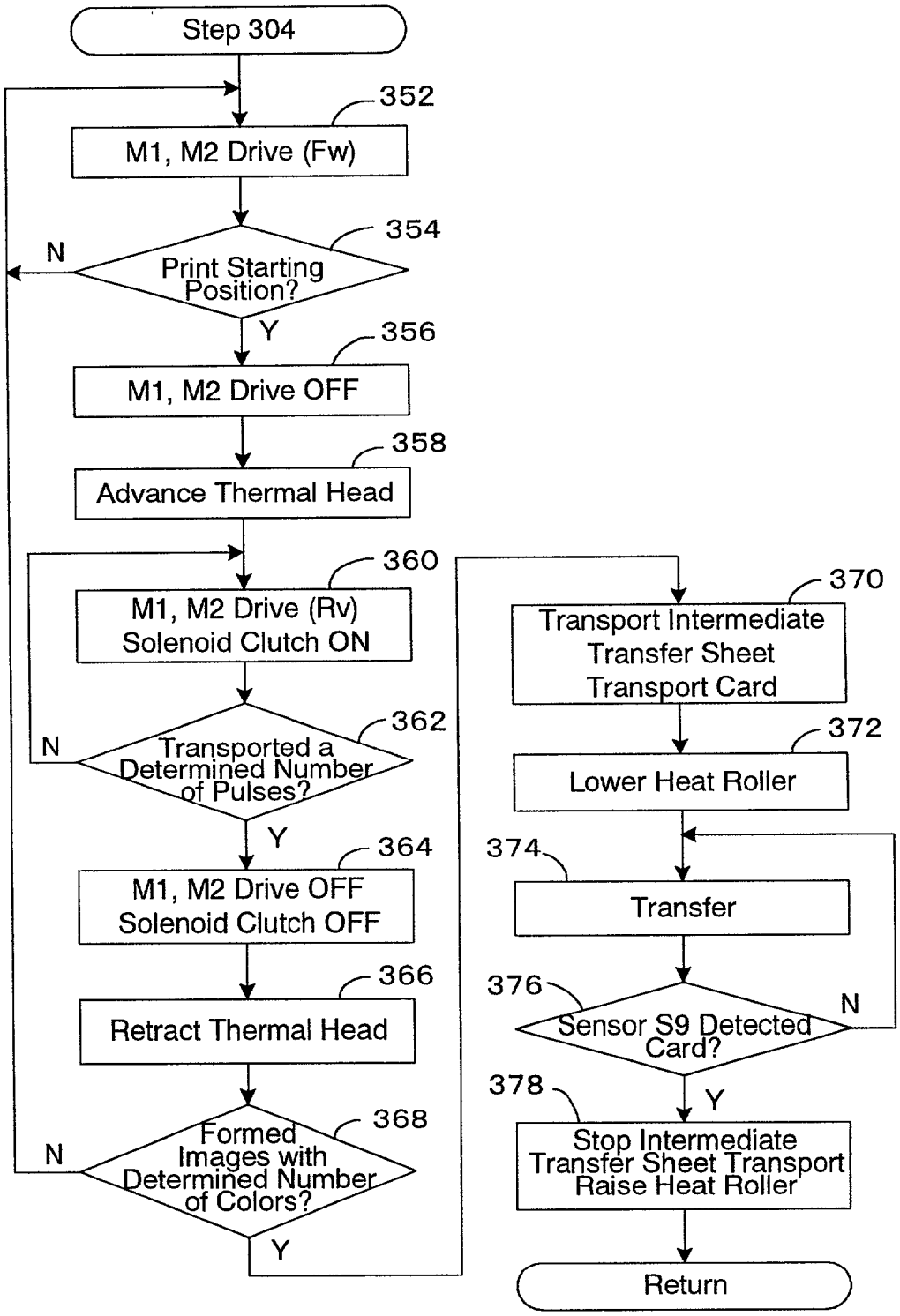
FIG. 10 is a flowchart of a subroutine of the indirect transfer process showing the details of step 304 of the image forming routine.

Referring to FIG. 10, in the indirect transfer process sub-routine, initially, at step 352 the pulse motors M1 and M2 rotate in the feed direction (Fw). In the step 354, the mark for positioning formed on the intermediate transfer sheet F is recognized by monitoring the light reception sensor S2 and by detecting the amount of rotation of the clock plate 90 connected to the back-tension roller 88 that reversibly rotates the feeding and returning of the intermediate transfer sheet F always as a single unit, it is determined whether or not that the intermediate transfer sheet F has been transported to the printing starting position. If it is a negative decision, it returns to step 352 and continues transporting the intermediate transfer sheet F. If the decision is affirmative, the drive of the pulse motors M1 and M2 are stopped at step 356. During that time, the thermal head 20 is positioned away from the platen roller 21 and the thermal transfer sheet R is fed a determined distance to the printing position Sr, for example at the starting edge of Y (yellow). Such control enables detecting the trailing edge of the Bk (black) portion of the thermal transfer sheet R by the light emitting sensor S4, and detection of the rotation of the clock plate, not shown in the drawings, disposed near the paired take-up rollers 57 by the unitized transmissive sensor, not shown in the drawings, to detect the distance from the trailing edge of the Bk (black) portion having a predetermined width on the thermal transfer sheet R, to the Y (yellow) portion on the thermal transfer sheet R.

Next, at step 358, the thermal head sliding cam 23 is rotated in the direction of the arrow A to touch the thermal head 20 against the platen roller 21 interposed therebetween by the thermal transfer sheet R and the intermediate transfer sheet F. Next, at step 360, while rotating the pulse motor M1 and the pulse motor M2 in the reverse (Rv) direction, the platen roller 21 is rotated in the counterclockwise direction by interlocking the solenoids 67 and 131 thereby rotating the transport roller 58 in the counterclockwise direction. This starts the forming of the image using the color Y (yellow) on the intermediate transfer sheet F. In other words, by the thermal head 20 heating the Y (yellow) ink layer on the thermal transfer sheet R, it starts forming the image on the receptive layer FE on the intermediate transfer sheet F. The driving force provided by the pulse motor M1 rotates the platen roller 21 in the counterclockwise direction and the driving force of the pulse motor M2 takes up the intermediate transfer sheet F by the intermediate transfer sheet supply portion 16 and in synchronization to that the thermal transfer sheet R is taken up by the thermal transfer sheet take-up portion 15.

At step 362, by determining whether or not the pulse motor M1 has rotatingly driven the determined number of pulses that correspond to the size of the length direction of the image formed on the intermediate transfer sheet F, it is determined whether or not the forming of the image on the intermediate transfer sheet F has been completed. When it is negative, it returns to step 360 and continues forming the image on the intermediate transfer sheet F. If affirmative, along with stopping the drive of both the pulse motor M1 and M2 at the step 364, it releases the interlock of the solenoids 67 and 131 on the platen roller 21 and transport roller 58. Note that the CPU pre-converts image information into thermal energy, via the thermal head control unit 19H and sends the mirrored image data to the thermal head 20 with the determined coefficients relating to the type of the intermediate transfer sheet F added to that thermal energy. The printing elements of the thermal head 20 are heated according to the mirror image data.

At step 366, the thermal head sliding cam 23 rotates to retract the thermal head 20 from the platen roller 21 and at step 368, it determines whether or not the forming of the image for the prescribed colors (YMC) has been completed. When it is negative, it returns to step 352 to form the image over the color already formed on the receptive layer on the intermediate transfer sheet F (for example, Y) with the next color (for example, M). If affirmative, in other words, if it is determined that the forming of the image using the colors YMC has been completed and it proceeds to step 370.

At the next step of 370, the pulse motor M2 is driven, and the intermediate transfer sheet F is transported according to the rotating amount of the clock plate mounted onto the back-tension roller 88, to the position of the heat roller 45 already separated from the platen roller 50. When transporting, by monitoring the output from the light receiving sensor arranged between the guide roller 44 and the guide plate 47 in the transfer portion 10, it detects the mark for positioning the intermediate transfer sheet F making it possible to reset the amount of transport at this point to improve the accuracy of the transport.

Also, at step 370, in parallel to transporting the intermediate transfer sheet F to the transfer portion 10, the card C is fed from the card supply portion 3 along the second card transport path P2 until the leading edge thereof abuts the heat roller 45. Specifically, while rotatingly driving card supply portion 3, the cleaner 4 and the pinch rollers 38 and 39 on the turning portion 5, the pulse motor M3, not shown in the drawings, is driven to rotate the paired horizontal transport rollers 11, the paired transport rollers 48 and each of the rollers on the horizontal transport portion 12 and one card C is sent from the card supply portion 3 to the second card transport path P2 where both surfaces of the card C are cleaned by the cleaner 4. When the unitized transmissive sensor S5, not shown in the drawings, detects the leading edge of the card C, it stops the rotation of the kick roller 31. Continuing, the card C is transported further in the direction of the arrow L through the turning portion 5 along the second card transport path P2. When the unitized transmissive sensor S7, not shown in the drawings, arranged on the paired horizontal transport rollers 11 side near the transport roller 48 detects the leading edge of the card C, the card is transported further a determined number of pulses in the direction of the arrow L. This transports the leading edge of the card C to the position touching the heat roller 45. Note that the point at which the unitized transmissive sensor S8, not shown in the drawings, detects the leading edge of the card C, the rotational drive of the pinch rollers 38 and 39 is stopped.

Next, at step of 372, the heat roller elevator cam 51 is rotated in the direction of the arrow B and shifts the heat roller 45 from being separated from the platen roller 50 (see FIG. 14A) to touching the platen roller 50 (see FIG. 14B), then stops the rotation of the heat roller elevator cam 51. At this point, the leading edge of the card C touches the heat roller 45, a side of the card C being supported by the platen roller 50 and the intermediate transfer sheet F interposed between the other side of the card C and heat roller 45.

Next, at step 374, images formed on the reception layer Fe on the intermediate transfer sheet F are indirectly transferred to one side of the card C at the image forming portion 9 using the thermal transfer of the heat roller 45. To describe the operations that occur here at step 374 in more detail, the card C, the other thereof supported by the platen roller 50 that rotates in the counterclockwise direction, is touched to the heat roller 45 with one surface interposed by the intermediate transfer sheet F and is transported in the direction of the arrow L. The peeling layer Fc on the intermediate transfer sheet F is peeled away from the base film Fa by the heat of the heating lamp 46 and through the pressure of the heat roller 45, the layer Fe formed thereupon with an image and the overcoat layer are transferred to the other side of the card C as a single body. In synchronization to this transfer, the intermediate transfer sheet F is taken up by the intermediate transfer sheet take-up portion 17. During this time, at step 376, by monitoring whether or not the leading edge of the card C is at the position of the unitized transmissive sensor S9 arranged on the paired discharge roller 142 side near the paired rollers that have no drive arranged between the capstan rollers 141 and the paired discharge rollers 142, it determines whether or not the intermediate transfer has been completed. If uncompleted, it returns to step 374 and continues the indirect transfer. If indirect transfer has been completed, it proceeds to the next step of 378. Note that the transport speed of the card C and the intermediate transfer sheet F during indirect transfer are the same.

At step 378, by stopping the drive of the pulse motors M2 and M3, the transport of the intermediate transfer sheet F (rewinding to the intermediate transfer sheet take-up portion 17) and the transport of the card C in the direction of the arrow L are stopped. The heat roller elevator cam 51 is re-rotated to retract the heat roller 45 from the platen roller 50 completing the intermediate transfer process sub-routine. It then proceeds to step 306, shown in FIG. 9.

At step 306, the card C is transported in the direction of the arrow R on the second card transport path P2, both edges nipped by the pinch rollers on the turning portion 5 to transport it. Specifically, the pinch rollers 38 and 39 and the pulse motor M3, not shown in the drawings, are reversingly rotated to pass the leading edge of the card C through the transfer portion 10 and the paired horizontal transport rollers 11 and after the unitized transmissive sensor S11 arranged near the turning portion 5 on the side of the paired horizontal transport rollers detects the leading edge of the card C, it transports the card C further in the direction of the arrow R a determined number of pulses, then stops the drive of the pinch rollers 38 and 39 and the pulse motor M3, not shown in the drawings. This allows both edges of the card C to be nipped by the pinch rollers 38 and 39 on the turning portion 5 in a horizontal orientation.

At step 308, the horizontally oriented turning portion 5 is rotated 90°0 to allow the card C positioned on the second card transport path P2 to be transported in the direction of the arrow U on the first card transport path P1 (see the dotted lines in FIG. 1) . This positions the card C with the other side at the thermal head 20 side and the one side at the platen roller 21 on the second card transport path P2.

Next, at step 310, the direct transfer process sub-routine for forming images on the other side of the card C by the direct transfer method is executed.

Figure 11:
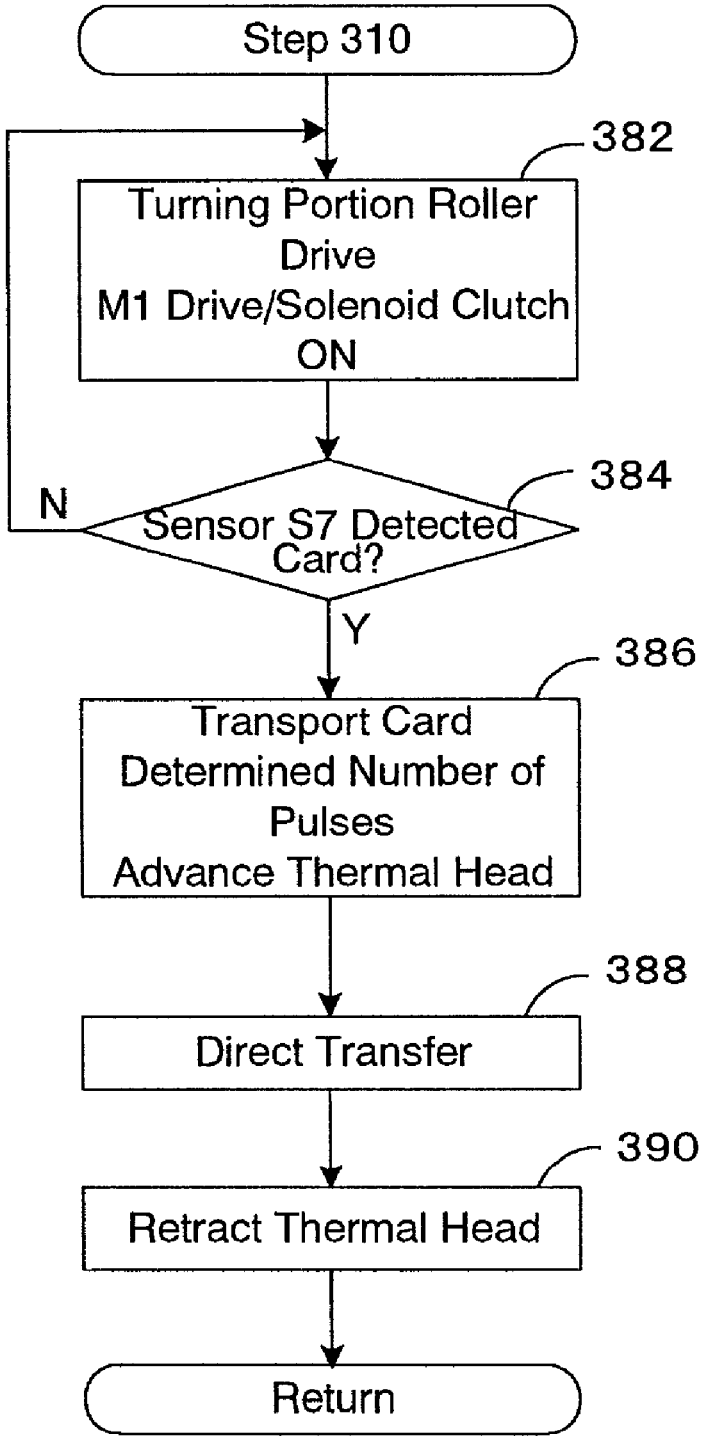
FIG. 11 is a flowchart of a subroutine of the direct transfer process showing the details of step 310 of the image forming routine.

As can be seen in FIG. 11, in the direct transfer process sub-routine, at step 328, the pinch rollers 38 and 39 are rotatingly driven and while starting the rotating drive of the pulse motor M1 to the pulse motor M1 motor driver, the solenoid clutch 67 transmits the drive from the pulse motor M1 to the platen roller 21. Through this, the rotational drive of the pinch rollers 38 and 39, the platen roller 21, and the capstan rollers 74 and 78 is started, the card C begins transport along the first card transport path P1 in the direction of the arrow U where the image forming portion 9 is arranged. Also, the intermediate transfer sheet F begins transport to the intermediate transfer sheet supply portion 16 (a rewind).

At the next step 384, the unitized transmissive sensor S7, not shown in the drawings, arranged between the capstan roller 78 and the thermal head 20 determines if the leading edge of the card C has been detected. If negative, it returns to the step 382 and continues the transport of the card C to the image forming portion 9. If affirmative, at step 386, it transports the leading edge of the card C in the direction of arrow U a determined number of pulse so the leading edge of the card C reaches the printing position Sr. The pinch rollers 38 and 39 on the turning portion 5 stop rotating at the point where the unitized transmissive sensor S6, not shown in the drawings, arranged between the turning portion 5 and the image forming portion 9, detects the trailing edge of the card C. During that time, the thermal head 20 is positioned away from the platen roller 21 (see FIG. 13A) and the thermal transfer sheet R is fed a determined distance to the printing position Sr, for example at the starting edge of Bk (black). Such control enables detecting the trailing edge of the Bk (black) portion of the thermal transfer sheet R by the light emitting sensor S4, and detection of the rotation of the clock plate, not shown in the drawings, disposed near the paired take-up rollers 57 by the unitized transmissive sensor, not shown in the drawings, to detect the distance from the trailing edge of the Bk (black) portion having a predetermined width on the thermal transfer sheet R, to starting edge of the next consecutively repeated Bk (black) portion on the thermal transfer sheet R. Next, at step 386, it starts the rotation of the thermal head sliding cam 23 in the direction of arrow A. This supports the other side of the card C at the platen roller 21 interposed therebetween by the intermediate transfer sheet F, one side touching the thermal head 20 interposed therebetween by the thermal transfer sheet R.

Continuing, at step 388, images are formed on the other side of the card C using the direct transfer method. Specifically, the pulse motor M1 drive rotates the platen roller 21 in the counterclockwise direction. In synchronization to that, the thermal transfer sheet R is taken-up by the thermal transfer sheet take-up portion 15 and black and white images are formed (printed) in Bk (black) by direct transfer to the other side of the card C. The other side of the card C at this time is pressed at the thermal head 20 while the one side of the card C supported at the platen roller 21 is pressingly touching the platen roller 21. Note that through the control portion 19 thermal control unit 19H, the thermal energy applied to the thermal head 20 when forming images to the other side of the card C is controlled so that the specific heat of the base film Fa itself on the intermediate transfer sheet F is lower than the specific heat of the card C and is larger the thermal energy applied to the thermal head 20 when forming images to the intermediate transfer sheet F. Operations of such thermal energy can be performed by changing coefficients to the thermal energy. Also, the data sent to the thermal head 20 from the thermal head control portion 19H when forming images on the card C varies from that for the indirect transfer described above. It is positive image data. Note that the intermediate transfer sheet F is transported at the same speed as the thermal transfer sheet R and the card C.

At the next step 390, the thermal head sliding cam 23 is rotated in the direction opposite to the arrow A to retract the thermal head 20 from the card C to complete the direct transfer process sub-routine. It then proceeds to step 312 shown in FIG. 9. Note that in direct transfer, as shown in FIG. 14A, the heat roller 45 on the transfer portion 10 maintains a separated state from the platen roller 50.

At step 312, while discharging the card C formed on both sides with images, to outside of the image forming apparatus 1, it prosecutes the discharge/transport sub-routine that transports unused portions adjacent to the area where images were formed on the intermediate transfer sheet F, to the image forming portion 9 in preparation for processing the next card C.

Figure 12:
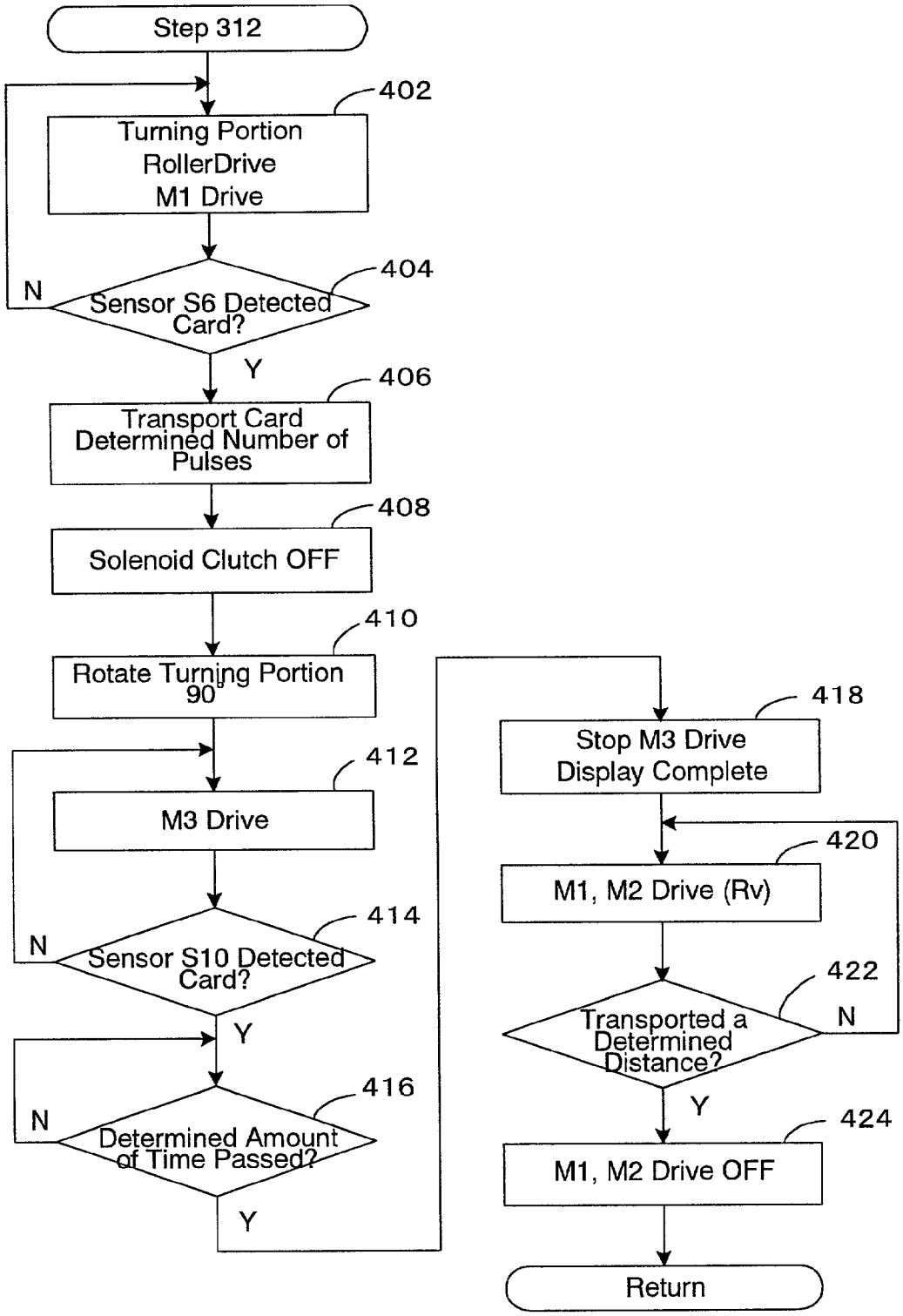
FIG. 12 is a flowchart of a subroutine of the discharge and transport processes showing the details of step 312 of the image forming routine.

As shown in FIG. 12, at the discharge/transport sub-routine, first at step 402, the pinch rollers 38 and 39 are reversingly rotated, then the reverse drive of the pulse motor M1 is started along with the coupling with the solenoid clutch 67 to transport the card C in the direction of the arrow D. At step 404, it determines if the trailing edge of the card C has been transported to the position of the unitized transmissive sensor S6, not shown in the drawings. If the decision is negative, it returns to step 402 and continues to transport the card C in the direction of the arrow D. If affirmative, at the next step 406, it transports the card C a determined number of pulses further in the direction of the arrow D.

Next, at step 408, the drive of the pulse motor M1 is stopped and the coupling of the platen roller 21 to the solenoid clutch 67 is stopped. The reverse rotation of the pinch rollers 38 and 39 is stopped to nip both edges of the card C in the pinch rollers 38 and 39 while the turning portion 5 is vertically oriented. At the next step 410, the vertically oriented turning portion 5 is rotate −90° to allow the card C positioned on the first card transport path P1 to be transported in the direction of the arrow L on the second card transport path P2. This positions the card C with the other side upward, on the second card transport path P2.

At step 412, the pulse motor M3, not shown in the drawings, is driven to transport the card C further in the direction of arrow L along the second card transport path P2. At step 414, it determines whether or not the unitized transmissive sensor S10, not shown in the drawings, arranged between the horizontal transport portion 12 and the discharge outlet 27 has detected the leading edge of the card C. If negative, it returns to step 312 to transport the card C further for discharge. If affirmative, it continues transporting the card C a predetermined amount of time at step 416 until the card C is completely discharged to outside of the image forming apparatus 1. This discharges the card C to the stacker 13 via the discharge outlet 27. Note that the point at which the unitized transmissive sensor S8, not shown in the drawings, detects the leading edge of the card C, the rotational drive of the pinch rollers 38 and 39 is stopped. Next, at step 418, the rotating drive of the pulse motor M3, not shown in the drawings, is stopped at which point the number of cards that have been processed or the completion of the processing of cards is displayed on the touch panel 8.

At step 420, the pulse motors M1 and M2 are driven in reverse. At step 422, the unitized transmissive sensor SA, described above, determines whether or not the intermediate transfer sheet F has been transported the determined distance. If negative, it returns to step 420 and continues the transport of the intermediate transfer sheet F. If affirmative, it stops the drives of the pulse motors M1 and M2 at the next step 424 and completes the discharge/transport subroutine and the image forming routine. On the other hand, when there is a negative determination at step 302 shown in FIG. 9, in other words, when in single side printing mode, at step 314, a different process for forming images on a single side of the card C is executed using the direct transfer method or the indirect transcription transfer method is executed, and the image forming routine is finished. In this other process, only the direction of transportation of the card C before and after direct transfer or indirect transfer is different, but processing substantially similar to the direct transfer process subroutine shown in FIG. 11 or the indirect transfer process subroutine shown in FIG. 10 is executed. This enables attaining card C formed thereupon with images on one side with the direct transfer and with images on the other side formed by the indirect transfer method.

Note that when directly transferring images to one side of the card C in this other process, often times color images containing the three colors of YMC are specified. In such cases, the forming of images using only Bk (black) does not occur, and the forming of images using the three colors of YMC, described below, is specified. At step 386, the thermal transfer sheet R is fed a determined distance to the printing position Sr, for example to the starting edge of Y (yellow). At step 388, images are formed on the card C using the three colors of YMC. Specifically, the pulse motor M1 drive rotates the platen roller 21 in the counterclockwise direction. In synchronization to that, the thermal transfer sheet R is taken-up by the thermal transfer sheet take-up portion 15 and the Y (yellow) image is formed (printed) by direct transfer to the card C. It rotates the thermal head sliding cam 23 in the direction opposite to the arrow A when the forming of the image by the Y (yellow) portion is completed and the thermal head 20 is retracted from the card. The CPU starts reversingly driving the pulse motor M1 after the thermal head 20 is retracted. This reversingly rotates the platen roller 21, the capstan rollers 74 and 78, and the card C is transported in the direction of the arrow D. The CPU stops the reverse rotational drive of the pulse motor M1 after the trailing edge of the card C passes the position of the unitized transmissive sensor S7, not shown in the drawings and the card C has been transported a determined number of pulses. Also, to print with the next die M (magenta), the CPU forward drives the pulse motor M1. After the leading edge of the card C is detected by the unitized transmissive sensor S7, not shown in the drawings, the CPU transports the card C in the direction of the arrow U for a determined number of pulses to the printing position Sr. During that time, the CPU feeds a minute amount of the thermal transfer sheet R until the leading edge of the next color M (magenta) is positioned at the print starting position Sr. Then, by rotating the thermal head sliding cam 23 in the direction of the arrow A, the thermal head 20 is pressed against the card C, therebetween interposed by the thermal transfer sheet R. The thermal head 20 forms the image of M (magenta) overlaying the previous color of Y (yellow) on the card C. The CPU, repeats the aforementioned processes in order to overlap images in the YMC inks on the surface of the card C.

The following shall describe the actions of the image forming apparatus 1 according to the second embodiment.

The image forming apparatus 2 according to the first embodiment comprises an image forming portion 9 that forms images on the card C or the intermediate transfer sheet F and a transfer portion 10 to transfer to the card C images formed on the intermediate transfer sheet F so it is possible to print with both the direct transfer and indirect transfer methods of printing. Furthermore, because it is possible in such situations to print to a single side or both sides by electing either of direct transfer or indirect transfer, the convenience to users is further improved.

In addition, with the image forming apparatus 1 according to the second embodiment, to print to both sides of the card C, using the indirect transfer process subroutine, after transporting the intermediate transfer sheet F to the image forming portion 9 (steps 352 to 356) and forming an image on the intermediate transfer sheet F at the image forming portion 9 (steps 358 to 368), the card C is transported to the transfer portion 10 while the intermediate transfer sheet F is transported to the transfer portion 10 (step 370) . At transfer portion 10, the image formed on the intermediate transfer sheet F is transferred to one side of the card C (steps 372 to 378) After execution of the indirect transfer process subroutine is completed, in the direct transfer subroutine, the card C is transported to the image forming portion 9 (steps 306, 308, 382 to 86) where images are formed on the other side of the card C at the image forming portion 9 (step 388). Therefore, images are formed by the indirect transfer method on one side of the card C and because images such as additional warnings are formed by the direct transfer method on the other side of card C, by switching the image forming method for each side of the card C, it is possible to form images on the card C using the most suitable image forming method. While reducing running costs of the intermediate transfer sheet F by forming images using the indirect transfer method only for one side of cards that require printing over the entire surface, and using the direct transfer method to print to the other side of the card C that does not require printing over the entire surface, the invention directly transfers to the other side of the card C after intermediate transferring images to one side of the card C, so by pressing (pressure contact) one side of the card C to the platen roller 21 when using the direct transfer method (step 388), the image previously formed on the one side of the card C by the indirect transfer method can be better affixed thereto. To describe the advantages of the latter in further detail, with the indirect transfer method, the images are affixed to the one side of the card C by heating and pressing the receptive layer Fe on the intermediate transfer sheet F along with the overcoat layer Fd. However, the affixing of the receptive layer F3 to the one side of the card C in the indirect transfer method is inferior to the affixing of the direct transfer method wherein the sublimate ink in the ink layer on the thermal transfer sheet R gasifies into the molecular structure of the card C by the heat of the thermal head 20 to stain the card C, so images affixed to the one side of the card C first using the indirect transfer method are pressed onto the card C from the other side by the thermal head 20 with the one side of the card C supported by the platen roller 21 when in the direct transfer method thereby improving the affixing of the image formed on the one side of the card C, and ensuring the stable images on both sides of the card C.

Furthermore, the image forming apparatus 1 of the present embodiment comprises the turning portion 5, and by turning over the card C with regard to the first card transport path P1 between the indirect transfer process subroutine and the direct transfer process subroutine (step 308), the card C can be executed upon using the direct transfer process subroutine after the indirect transfer process subroutine without discharging the card C from image forming apparatus 1, so the indirect transfer and direct transfer methods can be executed sequentially, thereby shortening the printing time and reducing mismatched images formed on both sides of the card C using the indirect transfer and direct transfer methods.

Still further, because with the image forming apparatus 1, images can be formed to the other side of the card C and to the intermediate transfer sheet F by the image forming portion 9, the image forming apparatus 1 can be more compact and can lower costs.

Note that in the present embodiment, an example forming an image, such as cautions, using a single color (monochrome) on one side of the card C was shown at step 388. However, according to the objective of the print, as described for the other process at step 314, images can be formed using a plurality of color scales, or conversely, the images of steps 358 to 368 printed using only a single color. In addition, when, at step 410, the card C positioned on the first card transport path P1 is transported in the direction of arrow L on the second card transport path P2, the perpendicular turning portion 5 is rotated −90° to set the other side of the card C upward and to transport it to the second card transport path P2.

Furthermore, when an image on both sides of the card C as described above, according to the first embodiment, the routine is explained that after having transferred an image to one side of the card C directly, images are formed on the other side of the card C using the image forming routine that uses the indirect transfer method. According to the second embodiment, after indirectly transferring images to the one side of the card C, the image forming routine that directly transfers images to the other side of the card C. However, this embodiment comprises a configuration, for example, wherein by driving or activating each of the mechanisms using an operational instruction from the touch panel 8, it is possible to freely set the order to form images of forming images using the direct transfer method or forming images using the indirect transfer method, without the present invention being limited thereto. This further enhances printer user convenience.

As described above, on the image forming apparatus 1 according to the first and the second embodiments thereof, between the thermal head 20 and the platen roller 21, the thermal transfer sheet R, the card C and the intermediate transfer sheet F are interposed and images are formed (printing) by thermal transfer. However, the transport speed of the thermal transfer sheet R, the card C and the intermediate transfer sheet F are set to be the same (because they are transported in synchronization) so little friction is generated by the contacting of the intermediate transfer sheet F on the card C and thus problems of the card C being damaged because of friction with the intermediate transfer sheet F do not occur. Therefore, even if the intermediate transfer sheet F and the card C are transported while in contact while using the direct transfer method, there is no damage by the intermediate transfer sheet F, so no problems occur by using the intermediate transfer sheet F in the indirect transfer method. Furthermore, the hardness of the card C is much greater than that of the intermediate transfer sheet F, so there is no damage by contact friction with the intermediate transfer sheet F. Thus, when one transfer method is chosen, the other transfer method can be used to print without problems, enabling sure printing by both methods.

Furthermore, because the aforementioned image forming apparatus 1 transmits the driving force of single pulse motor M1 to the platen roller 21 and the capstan rollers 74 and 78 as the state that couples the solenoid clutch 67 when in the direct transfer method and employs a drive mechanism synchronized to the transport of the card C and to the intermediate transfer sheet F, it prevents damage of the intermediate transfer sheet F that occurs by a discrepancy in the transport timing of the intermediate transfer sheet F and the card C, and compared with the configuration to transport the card C and the intermediate transfer sheet F separately, the use of members can be shared, thereby enabling a more compact overall printing apparatus, lighter weight and lower costs.

In addition, when the aforementioned image forming apparatus 1 is set to the indirect transfer method, the transport of the card C and the transport of the intermediate transfer sheet F are separated by the solenoid clutch 67, and because the intermediate transfer sheet F is transported by the driving force of pulse motor M2, any slack in the intermediate transfer sheet F is alleviated, which prevents the intermediate transfer sheet F to become caught up in the rollers in the transport path. Also, when the indirect transfer method is set, as an exception to that just described, the driving force of pulse motor M1 is transmitted to the platen roller 21 by the solenoid clutch 67 only when rewinding (Rv) when forming images, but in this case, the relationship of the transport speeds of the intermediate transfer sheet F is that the supply spool shaft 120 is greater than the platen roller 21 which is greater than the back-tension roller 88. Because the speed on the upstream side of the rewind is high, the intermediate transfer sheet F does not get caught up in the rollers in the transport path.

Note that with the aforementioned image forming apparatus 1, the solenoid clutch 67 is shown to be between pulleys 66 and 68, but the present invention is not limited to this. For example, the pulleys 66 and 68 and the solenoid clutch 67 can be eliminated and a pulley mated to the shafts of the capstan rollers 74 and 78 coupling each with a belt therebetween with the pulley 64. A solenoid clutch can be mated to the shafts of the capstan rollers 74 and 78, and the driving force of pulse motor M1 may be transmitted through the solenoid clutch via the gear 72 to the platen roller 21. With such configuration, the driving force of pulse motor M1 is transmitted from the capstan rollers 74 and 78 to the platen roller 21, so the direction of transmission is reverse of that described for the present embodiment, but same effect as of preventing the intermediate transfer sheet F from being caught up, described above, is attained.

Also, the aforementioned explanation describes one example of the image forming portion 9 but this invention is not limited to one and can also comprise a plurality of image forming portions 9 (for example two). In this way, on one image forming portion, images can be formed on the card C, and formed on the intermediate transfer sheet F at the other image forming portion, thereby further enhancing the printing speed while reducing errors such as entangling of the intermediate transfer sheet.

Thus, as described above, according to the present invention, to print to both sides of a recording medium, in the first image forming process, images are formed on one side of a recording medium with the direct transfer method and in the second image forming process, images are formed to the other side of the recording medium using the indirect transfer method, or in the second image forming process, images are formed to one side of a recording medium using the indirect transfer method and in the first image forming process, images are formed to the other side of a recording medium using the direct transfer method, still yet in the first image forming process images can be formed to one side of the aforementioned recording medium and images formed in any desired order on the other side of the aforementioned recording medium using the second image forming process, so by switching between image forming methods at the first image forming process and the second image forming process, either transfer method can be employed, thereby improving user convenience, and enabling image forming to the recording medium using the optimum image forming method, and reducing running costs.

Note that by executing the second image forming process after the first image forming process, the security of personal information can be ensured in abnormal situations on the aforementioned image forming apparatus when forming images of personal information, including photographs, on the other side of the recording medium at the second image forming process because after forming images in the first image forming process, even if the recording medium is unavoidably discharged from the image forming apparatus executed by this invention and the forming of images of the personal information are not performed on the other side of the recording medium. Also, by executing the first image forming process after the second image forming process, pressure is applied to the other side of the recording medium accompanying the forming of images on the other side of the recording medium at the later process of the first image forming process, the portion of the image forming, formed on the one side of the recording medium previously performed at the second image forming process being pressed so images formed on one side of the recording medium by the indirect transfer method are further affixed thereto.

Still further, as a result that the recording medium and the intermediate transfer medium are reciprocally transported in contact at the printing position when using the direct transfer method with low friction therebetween, there is no damage caused by friction with the intermediate transfer medium to enable secure printing of both methods.

What we claim is:

1. An image forming method comprising:

a first image forming process wherein a recording medium is transported to a first position for forming first images on the recording medium, and the first images are formed on said recording medium at said first position; and a second image forming process wherein an intermediate transfer medium that temporarily holds second images is transported to a second position for forming the second images on the intermediate transfer medium, and after forming the second images on said intermediate transfer medium at said second position, said recording medium is transported to a third position for transferring the second images formed on the intermediate transfer medium to the recording medium, and said intermediate transfer medium is transported to said third position and the second images formed on said intermediate transfer medium are transferred to said recording medium at said third position;

wherein the second images are formed on one side of said recording medium in the second image forming process after the first images are formed on the other side of said recording medium in the first image forming process.

2. An image forming method according to claim 1, wherein said first images formed in said first image forming process are monochrome images.

3. An image forming method according to claim 1, wherein said second images formed in said second image forming process are color images.

4. An image forming method according to claim 3, wherein said second images formed in said second image forming process are images of personal information including photographs.

5. An image forming method according to claim 1, further comprising a turning process between said first image forming process and said second image forming process for turning the recording medium over.

6. An image forming method according to claim 1, wherein when said first image forming process is executed, said intermediate transfer medium and said recording medium are transported reciprocally while in contact with each other at said first position for forming the first images on the recording medium, and when said second image forming process is executed, only said intermediate transfer medium is reciprocally transported at said second position for forming the second images on the intermediate transfer medium.

7. An image forming method according to claim 6, wherein when said recording medium and said intermediate transfer medium are transported reciprocally while in contact with each other, said recording medium and said intermediate transfer medium are transported in synchronization.

8. An image forming method comprising:

a first image forming process wherein a recording medium is transported to a first position for forming first images on the recording medium, and the first images are formed on said recording medium at said first position; and a second image forming process wherein an intermediate transfer medium that temporarily holds second images is transported to a second position for forming the second images on the intermediate transfer medium, and after forming the second images on said intermediate transfer medium at said second position, said recording medium is transported to a third position for transferring the second images formed on the intermediate transfer medium to the recording medium, and said intermediate transfer medium is transported to said third position and the second images formed on said intermediate transfer medium are transferred to said recording medium at said third position;

wherein the first images are formed on one side of said recording medium in the first image forming process after the second images are formed on the other side of said recording medium in the second image forming process.

9. An image forming method according to claim 8, wherein in said second image forming process the second images are formed on a receptive layer that can receive the second images and is layered on said intermediate transfer medium, then the second images are formed on the recording medium by transferring the second images on said receptive layer to the other side of said recording medium.

10. An image forming method according to claim 9, wherein in said second image forming process said receptive layer with the second images is heated and pressed to transfer the second images to the other side of said recording medium.

11. An image forming method according to claim 8, wherein in said first image forming process the first images are formed on said recording medium by transferring thermal sublimate ink.

12. An image forming method according to claim 11, wherein when said first images are formed in said first image forming process, the other side of said recording medium with the second images formed in said second image forming process is pressingly touched to a recording medium support member that supports said recording medium.

13. An image forming method according to claim 8, further comprising a turning process between said second image forming process and said first image forming process for turning the recording medium over.

14. An image forming method according to claim 8, wherein when said first image forming process is executed, said intermediate transfer medium and said recording medium are transported reciprocally while in contact with each other at said first position for forming the first images on the recording medium, and when said second image forming process is executed, only said intermediate transfer medium is reciprocally transported at said second position for forming the second images on the intermediate transfer medium.

15. An image forming method according to claim 14, wherein when said recording medium and said intermediate transfer medium are transported reciprocally while in contact with each other, said recording medium and said intermediate transfer medium are transported in synchronization.

16. An image forming method comprising:

a first image forming process wherein a recording medium is transported to a first position for forming first images on the recording medium, and the first images are formed on said recording medium at said first position;

a second image forming process wherein an intermediate transfer medium that temporarily holds second images is transported to a second position for forming the second images on the intermediate transfer medium, and after forming the second images on said intermediate transfer medium at said second position, said recording medium is transported to a third position for transferring the second images formed on the intermediate transfer medium to the recording medium, and said intermediate transfer medium is transported to said third position and the second images formed on said intermediate transfer medium are transferred to said recording medium at said third position; and a selecting process wherein one of said first image forming process for forming the first images on one side of said recording medium and said second image forming process for forming the second images on the other side of said recording medium is selected to execute first.

* * * * *